US007429099B2

(12) United States Patent
Sugimoto et al.

(10) Patent No.: US 7,429,099 B2
(45) Date of Patent: Sep. 30, 2008

(54) LIQUID EJECTION HEAD, IMAGE FORMING APPARATUS, AND LIQUID EJECTION HEAD MANUFACTURING METHOD

(75) Inventors: Shinya Sugimoto, Kanagawa (JP); Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 434 days.

(21) Appl. No.: 11/236,541

(22) Filed: Sep. 28, 2005

(65) Prior Publication Data

US 2006/0066688 A1 Mar. 30, 2006

(30) Foreign Application Priority Data

Sep. 29, 2004 (JP) ..... 2004-285109

(51) Int. Cl.
*B41J 2/045* (2006.01)

(52) U.S. Cl. ..... 347/68; 347/71

(58) Field of Classification Search ..... 347/68–72
See application file for complete search history.

(56) References Cited

U.S. PATENT DOCUMENTS

| | | | | |
|---|---|---|---|---|
| 4,392,145 | A * | 7/1983 | Parkola | 347/71 |
| 5,289,209 | A * | 2/1994 | Suzuki et al. | 347/71 |
| 6,488,355 | B2 | 12/2002 | Nakamura et al. | |
| 6,758,554 | B2 * | 7/2004 | Kamei et al. | 347/70 |
| 6,808,254 | B2 | 10/2004 | Sakaida et al. | |
| 2002/0018095 | A1 | 2/2002 | Nakamura et al. | |
| 2002/0080215 | A1 | 6/2002 | Sakaida et al. | |
| 2003/0103118 | A1 | 6/2003 | Watanabe et al. | |
| 2003/0122902 | A1 | 7/2003 | Sakaida et al. | |
| 2003/0156164 | A1 | 8/2003 | Sakaida et al. | |
| 2003/0210304 | A1 * | 11/2003 | Takahashi | 347/68 |
| 2004/0041885 | A1 | 3/2004 | Hirota | |
| 2004/0090498 | A1 | 5/2004 | Sakaida et al. | |

FOREIGN PATENT DOCUMENTS

| | | | |
|---|---|---|---|
| JP | 2001-237503 | A | 8/2001 |
| JP | 2001-334661 | A | 12/2001 |
| JP | 2002-166543 | A | 6/2002 |

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The liquid ejection head includes: a core substrate of which base material is fiber, the core substrate being provided with a plurality of ejection ports and a plurality of pressure chambers which communicate respectively with the plurality of ejection ports; a diaphragm which is attached to one surface of the core substrate and has a piezoelectric element disposed thereon; a first laminated resin layer portion which is formed by laminating resin thin plates onto the surface of the core substrate to which the diaphragm is attached, the first laminated resin layer portion being provided with a common liquid chamber that supplies a liquid to the plurality of pressure chambers; a second laminated resin layer portion which is formed by laminating resin thin plates onto a surface of the core substrate opposite to the surface to which the diaphragm is attached, the second laminated resin layer portion being provided with a plurality of ejection flow passages that connect the plurality of pressure chambers respectively to the plurality of ejection ports; and a plurality of drive wires which supply a drive signal to the piezoelectric element, at least a part of the plurality of drive wires being formed within the first laminated resin layer portion in a substantially perpendicular direction to the surface on which the piezoelectric element is disposed, thereby standing upright within the common liquid chamber.

8 Claims, 17 Drawing Sheets

LIQUID EJECTION HEAD, IMAGE FORMING APPARATUS, AND LIQUID EJECTION HEAD MANUFACTURING METHOD

BACKGROUND OF THE INVENTION

1. Field of the Invention

The present invention relates to a liquid ejection head, an image forming apparatus, and a liquid ejection head manufacturing method, and more particularly to a liquid ejection head in which ejection ports for ejecting a liquid are disposed at a high density, an image forming apparatus, and a liquid ejection head manufacturing method.

2. Description of the Related Art

An inkjet printer (inkjet recording apparatus) having an inkjet head (liquid ejection head) in which a large number of nozzles (ejection ports) are arranged is known as an image forming apparatus. This inkjet printer records an image on a recording medium by depositing ink on the recording medium from the nozzles while moving the inkjet head relative to the recording medium.

In this type of inkjet printer, ink is supplied from an ink tank to a pressure chamber through an ink supply passage. A piezoelectric element is then driven by applying to the piezoelectric element an electric signal corresponding to image data, whereby a diaphragm constituting a part of the pressure chamber is deformed such that the volume of the pressure chamber decreases. As a result, the ink in the pressure chamber is ejected from the nozzle in liquid droplet form.

In this type of inkjet printer, a single image is formed on the recording medium by combining dots formed by the ink ejected through the nozzles.

In recent years, demands have been made of inkjet printers for high-quality image formation on a par with photographic prints. To realize such high image quality, it is possible to reduce the size of the ink droplets ejected through the nozzles by decreasing the nozzle diameter, and also to increase the number of pixels per unit area by arranging the nozzles at a higher density.

As a method of increasing the density of the nozzle array, it has been proposed that the nozzles be disposed in a two-dimensional matrix form.

For example, an apparatus is known in which a plurality of nozzles are arranged in a matrix form constituted by a plurality of rows inclined at fixed angles in relation to a head main scanning direction and a plurality of columns that are orthogonal to the head main scanning direction, and the planar form of a diaphragm which forms one surface of a pressure chamber provided for each nozzle is set in a substantially square shape or rhomboid shape. As a result, the ejection efficiency of the pressure chamber is improved, and the nozzles are disposed at a high density (see Japanese Patent Application Publication No. 2001-334661, for example).

Another apparatus is known in which a pressure chamber provided in a cavity plate is formed in a substantially rhomboid shape, an ink supply port is formed in one of the acute angle portions of the pressure chamber, and an ink ejection nozzle is formed in the other acute angle portion. As a result, a large number of ink pressure chambers corresponding to a large number of nozzles is provided without increasing the dimensions of the cavity plate, and thus the nozzles can be arranged at a high density (see Japanese Patent Application Publication No. 2002-166543, for example).

Further, Japanese Patent Application Publication No. 2001-237503 describes a thermal sheet produced with the aim of increasing heat radiation efficiency while remaining small in size, in which two sheets of conductive foil are laminated together and fixed to each other integrally. Mutually opposing linear grooves are formed in advance on the opposing surfaces of the two sheets of conductive foil by etching or laser processing so that when the two sheets are laminated together, an elongated hollow fluid channel is formed.

However, when the nozzle density is increased using inkjet head constitutions such as those described in the patent documents and so on described above, the following problems occur. Accordingly, it is difficult in reality to increase the nozzle density using these constitutions.

In an inkjet head such as those described in Japanese Patent Application Publication Nos. 2001-334661 and 2002-166543, a common ink flow passage, an ink supply passage, the pressure chamber, and the nozzle are all disposed on the same side of the diaphragm that forms one wall surface of the pressure chamber, and a piezoelectric actuator is disposed on the opposite side.

When the density of the nozzles is increased with such a constitution, the size of the common flow passage is reduced as the density increases, and hence when an attempt is made to eject ink by driving a large number of nozzles at high frequency, ink supply to the pressure chamber cannot keep up with the ink ejection.

When a common liquid chamber which supplies liquid to the pressure chamber is provided on the rear side of the diaphragm (the opposite side to the side on which the pressure chamber is provided), it is possible to increase the nozzle density, but as a result, it becomes difficult to mount drive wiring for supplying drive signals to the piezoelectric element.

More specifically, when an attempt is made to increase the nozzle density by providing the pressure chamber on one side of the diaphragm and providing the common liquid chamber on the other side, the area for mounting drive wiring on the rear side of the diaphragm or the like decreases in size, and hence it becomes difficult to mount the drive wiring in reality. Alternatively, it becomes difficult to draw out the drive wiring, with the result that it also becomes difficult to manufacture the inkjet head.

Thermosetting resin can be subjected to heat treatment easily, but when resin layers made from such a resin are laminated together to form the inkjet head, warping may occur. In an inkjet head in particular, liquid ink is used, and therefore the parts which contact the liquid must be liquid-resistant. However, when resin layers are laminated together by means of so-called build-up, gaps and the like may appear between the layers due to warping, and the ink may flow into these gaps.

SUMMARY OF THE INVENTION

The present invention has been contrived in consideration of these circumstances, and it is an object thereof to provide a liquid ejection head, an image forming apparatus, and a liquid ejection head manufacturing method, in which ejection ports can be disposed at a high density, and with which manufacture can be simplified.

In order to attain the aforementioned object, the present invention is directed to a liquid ejection head, comprising: a core substrate of which base material is fiber, the core substrate being provided with a plurality of ejection ports and a plurality of pressure chambers which communicate respectively with the plurality of ejection ports; a diaphragm which is attached to one surface of the core substrate and has a piezoelectric element disposed thereon; a first laminated resin layer portion which is formed by laminating resin thin plates onto the surface of the core substrate to which the diaphragm is attached, the first laminated resin layer portion being provided with a common liquid chamber that supplies a liquid to the plurality of pressure chambers; a second laminated resin layer portion which is formed by laminating resin thin plates onto a surface of the core substrate opposite to the surface to which the diaphragm is attached, the second laminated resin layer portion being provided with a plurality of ejection flow passages that connect the plurality of pressure chambers respectively to the plurality of ejection ports; and a plurality of drive wires which supply a drive signal to the piezoelectric element, at least a part of the plurality of drive wires being formed within the first laminated resin layer portion in a substantially perpendicular direction to the surface on which the piezoelectric element is disposed, thereby standing upright within the common liquid chamber.

According to this constitution, the pressure chamber in the core substrate and the common liquid chamber in the first laminated resin layer portion are disposed on either side of the diaphragm, and the drive wires are disposed so as to stand upright within the common liquid chamber. As a result, the drive wires can be increased in density easily, and the ejection ports can be disposed at a high density. Moreover, by disposing the laminated resin layer portions on both sides of the rigid core substrate, warping of the liquid ejection head can be prevented, thereby facilitating manufacture using the so-called build-up method.

The plurality of drive wires can be arranged in various ways. For example, the plurality of drive wires are formed to stand upright from the piezoelectric element or the vicinity of the piezoelectric element. Alternatively, when the plurality of ejection ports are arranged two-dimensionally, the plurality of drive wires are arranged two dimensionally in relation to the surface on which the piezoelectric element is disposed.

Preferably, the core substrate is constituted by a glass epoxy resin comprising glass fiber and epoxy resin.

By means of this constitution, the rigidity of the core substrate can be increased, and warping can be further prevented.

Preferably, the second laminated resin layer portion is formed with at least one of a pseudo-space which communicates with outside, and a filled portion constituted by an enclosed space from which a filling material is not removed.

By means of this constitution, the area ratio of the thin plates above and below the core substrate can be made substantially identical. By disposing the thin plates to have a substantially identical area ratio above and below the core substrate, warping can be prevented further. In a case where both the pseudo-space communicating with the outside and the filled portion that remains filled with the filling material are formed, stress can be regulated by adjusting the distribution and disposal of the pseudo-space and filled portion.

Preferably, the second laminated resin layer portion is formed with electric wires parallel to the drive wires.

By means of this constitution, conductive components are distributed evenly on the upper and lower sides of the core substrate, and hence warping can be prevented even further.

Preferably, a number of the thin plates constituting the first laminated resin layer portion is identical to a number of the thin plates constituting the second laminated resin layer portion.

By means of this constitution, the same number of layers is formed on the upper and lower sides of the core substrate, and hence a further simplification of the structure can be achieved.

Preferably, the thin plates constituting the first laminated resin layer portion and the second laminated resin layer portion decrease in thickness steadily away from the core substrate.

By means of this constitution, warping can be prevented even further.

Preferably, a sectional area of each of the drive wires decreases steadily away from the core substrate.

By means of this constitution, an IC chip can be mounted on the liquid ejection head directly, by means of bump packaging or the like, and hence a further increase in the density of the drive wires can be achieved.

In order to attain the aforementioned object, the present invention is also directed to an image forming apparatus, comprising the above-described liquid ejection head.

By means of this constitution, an image can be formed at high density.

In order to attain the aforementioned object, the present invention is also directed to a method of manufacturing a liquid ejection head, comprising the steps of: forming a plurality of pressure chambers which apply pressure to a liquid to be ejected by boring holes in a core substrate of which base material is fiber; attaching a diaphragm on which a piezoelectric element is disposed to one surface of the core substrate; and laminating resin thin plates onto both sides of the core substrate substantially simultaneously in layers which oppose each other on either side of the core substrate, thickness of the resin thin plates being substantially identical between opposing layers, thereby forming a first laminated resin layer portion on the surface of the core substrate to which the diaphragm is attached, the first laminated resin layer portion being provided with a common liquid chamber that supplies a liquid to the plurality of pressure chambers, and forming a second laminated resin layer portion on a surface of the core substrate opposite to the surface to which the diaphragm is attached, the second laminated resin layer portion being provided with a plurality of ejection flow passages that extend from the plurality of pressure chambers to the plurality of ejection ports respectively.

By means of this constitution, the pressure chamber in the core substrate and the common liquid chamber in the first laminated resin layer portion are disposed on either side of the diaphragm, and hence the ejection ports can be disposed at a high density. Furthermore, resin thin plates having a substantially identical thickness are laminated onto both sides of the rigid core substrate substantially simultaneously, and hence warping of the liquid ejection head can be prevented, thereby facilitating manufacture using the so-called build-up method.

Preferably, in the laminating step, the layers which oppose each other on either side of the core substrate are subjected to at least heat treatment simultaneously.

In other words, the term "laminating . . . substantially simultaneously" may mean that at least heat treatment is performed simultaneously.

When only heat treatment is performed simultaneously, so-called build-up can be performed easily while preventing warping of the liquid ejection head.

Preferably, in the laminating step, at least one of a space portion area ratio and a wiring portion area ratio in the thin plates is substantially equal between the layers that are laminated substantially simultaneously onto either side of the core substrate.

By means of this constitution, the area ratio of the opposing layers that are laminated onto either side of the core substrate substantially simultaneously is substantially equal, and therefore warping can be prevented even further.

Preferably, in the laminating step, a drive wire which supplies a drive signal to the piezoelectric element is formed at least partially within the first laminated resin layer portion in a substantially perpendicular direction to the surface on which the piezoelectric element is disposed, thereby standing upright within the common liquid chamber.

By means of this constitution, the drive wires are disposed so as to stand upright within the common liquid chamber, and therefore the drive wires can be increased in density without complicating the drive wire array. As a result, the ejection ports can be disposed at a high density.

Preferably, in the laminating step, at least one of a pseudo-space which communicates with outside, and a filled portion constituted by an enclosed space from which a filling material is not removed, is formed in the second laminated resin layer portion.

By means of this constitution, the area ratio of the thin plates above and below the core substrate can be made substantially identical. By disposing the thin plates to have a substantially identical area ratio above and below the core substrate, warping can be prevented further. In a case where both the pseudo-space communicating with the outside and the filled portion that remains filled with the filling material are formed, stress can be regulated by adjusting the distribution and disposal of the pseudo-space and filled portion.

According to the present invention, the drive wires can be increased in density, and hence the ejection ports can be disposed at a high density. Moreover, the liquid ejection head can be manufactured easily through resin build-up while preventing warping.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
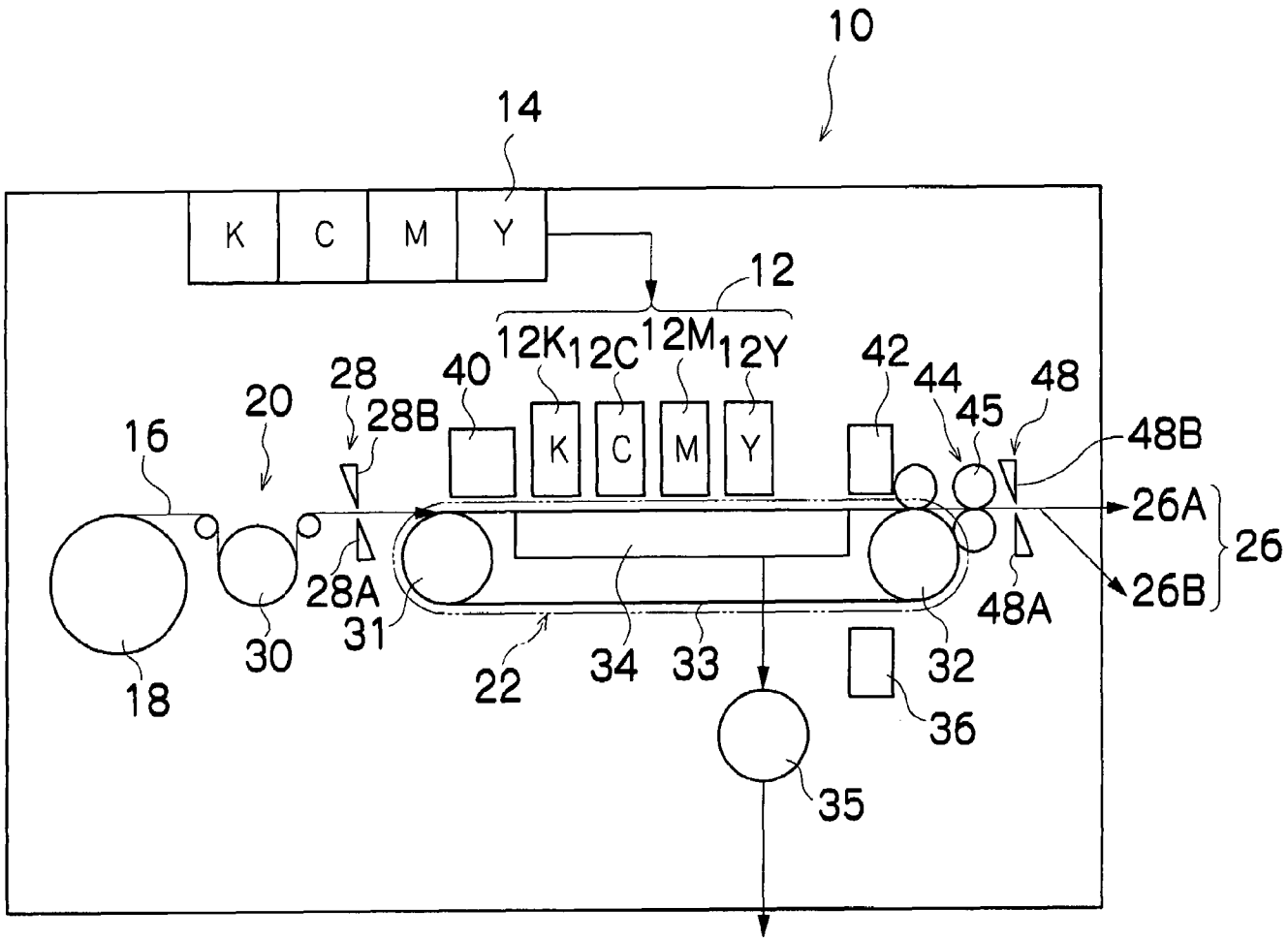
FIG. 1 is a general schematic drawing showing an outline of an example of an inkjet recording apparatus serving as an image forming apparatus comprising a liquid ejection head according to the present invention.

FIG. 1 is a general schematic drawing showing an outline of an example of an inkjet recording apparatus serving as an image forming apparatus comprising a liquid ejection head according to the present invention.

As shown in FIG. 1, an inkjet recording apparatus 10 comprises a print unit 12 having a plurality of print heads (liquid ejection heads) 12K, 12C, 12M, 12Y provided for ink colors, an ink storing and loading unit 14 in which the ink supplied to the print heads 12K, 12C, 12M, 12Y is stored, a paper supply unit 18 which supplies recording paper 16, a decurling unit 20 which removes curls from the recording paper 16, a suction belt conveyance unit 22 disposed opposite a nozzle face (ink ejection face) of the print unit 12 for conveying the recording paper 16 while maintaining the flatness of the recording paper 16, and a paper output unit 26 which outputs the printed recording paper (printed object) to the outside.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of an apparatus constitution using rolled paper, as shown in FIG. 1, a cutter 28 is provided, and the rolled paper is cut into the desired size by this cutter 28. The cutter 28 is constituted by a stationary blade 28A having a length which is equal to or greater than the width of the conveyance path for the recording paper 16, and a round blade 28B which moves along the stationary blade 28A. The stationary blade 28A is provided on the rear side of the print surface, and the round blade 28B is disposed on the print surface side so as to sandwich the conveyance path together with the stationary blade 28A. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

Following decurling, the cut recording paper 16 is delivered to the suction belt conveyance unit 22. The suction belt conveyance unit 22 is structured such that an endless belt 33 is wrapped around rollers 31 and 32 so that the part of the endless belt 33 facing at least the nozzle face of the printing unit 12 forms a horizontal plane (flat plane).

The belt 33 has a greater width dimension than the width of the recording paper 16, and a plurality of suction apertures (not shown) are formed on the belt surface. A suction chamber 34 is disposed in a position facing the nozzle face of the print unit 12 on the inside of the belt 33 wrapped around the rollers 31 and 32, as shown in FIG. 1. The suction chamber 34 provides suction by means of a fan 35, thereby generating negative pressure so that the recording paper 16 is held on the belt 33 by suction. The belt 33 is driven in the clockwise direction in FIG. 1 when the motive force of a motor (not shown) is transmitted to at least one of the rollers 31 and 32 around which the belt 33 is wrapped, and thus the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 forms a so-called full-line head (see FIG. 2) in which line heads having a length which corresponds to the maximum paper width are disposed in an orthogonal direction (main scanning direction) to the paper conveyance direction (sub-scanning direction).

Figure 2:
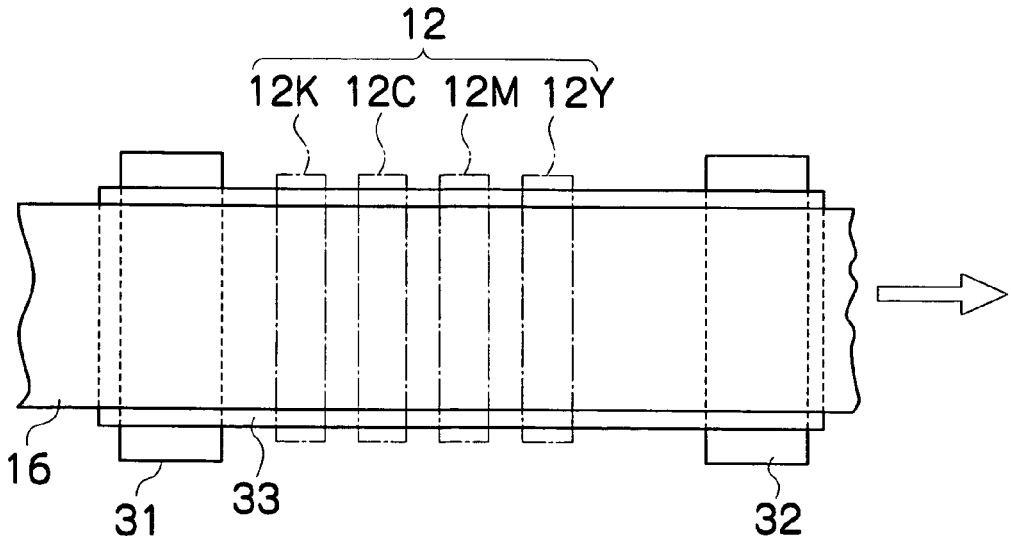
FIG. 2 is a principal plan view showing the periphery of a print unit in the inkjet recording apparatus shown in FIG. 1.

As shown in FIG. 2, each print head 12K, 12C, 12M, 12Y is constituted as a line head in which a plurality of ink ejection ports (nozzles) are arranged over a length which exceeds at least one side of the maximum sized recording paper 16 that can be used in the inkjet recording apparatus 10.

The print heads 12K, 12C, 12M, 12Y corresponding to the ink colors are disposed in order of black (K), cyan (C), magenta (M), and yellow (Y) from the upstream side (the left side in FIG. 1) in the conveyance direction (paper conveyance direction) of the recording paper 16. A color image can be formed on the recording paper 16 by depositing colored ink thereon from the respective print heads 12K, 12C, 12M, 12Y while conveying the recording paper 16.

According to the print unit 12, in which a full line head covering the entire paper width is provided for each ink color, an image can be recorded on the entire surface of the recording paper 16 by performing an operation to move the recording paper 16 relative to the print unit 12 in the paper conveyance direction (sub-scanning direction) a single time (i.e. with one sub-scan). In so doing, it is possible to achieve a higher print speed than that of a shuttle head, in which the print head performs a reciprocating movement in an orthogonal direction (the main scanning direction) to the paper conveyance direction. As a result, an improvement in productivity can be achieved.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 comprises tanks storing colored ink corresponding to the print heads 12K, 12C, 12M, 12Y. Each tank communicates with its print head 12K, 12C, 12M, 12Y via a pipe not shown in the drawing. The ink storing and loading unit 14 further comprises a notification device (a display device, warning sound generating device or the like) for providing notification of a low remaining ink amount, and a mechanism for preventing situations in which the wrong ink color is loaded.

A post-drying unit 42 is disposed following the print head 12K, 12C, 12M, 12 Y. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the output unit 26A for the target image is provided with a sorter for collecting images according to print orders.

Figure 3:
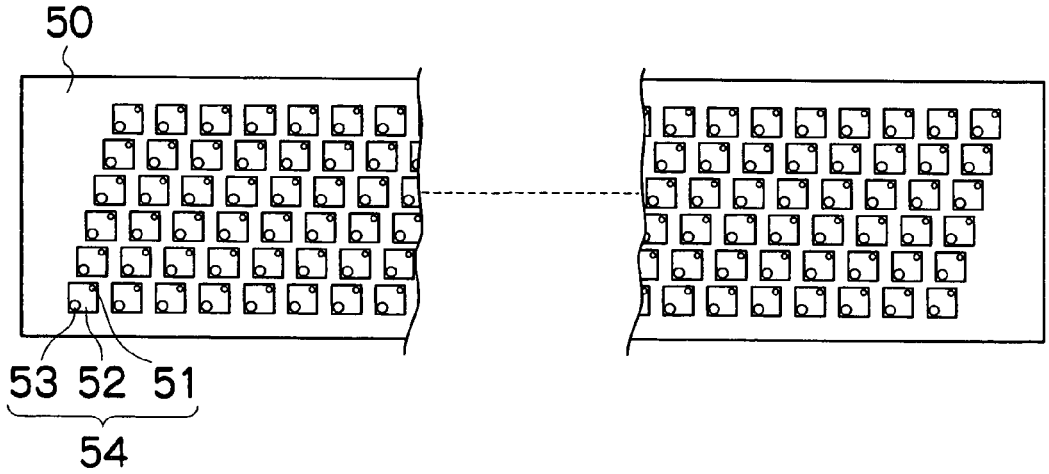
FIG. 3 is a projected plan view showing a structural example of a print head.

Next, the nozzle (liquid ejection port) arrangement in the print head (liquid ejection head) will be described. The print heads 12K, 12C, 12M, 12Y provided for the ink colors have a common structure, and hence in the following description, the print heads will be represented by the reference numeral 50. FIG. 3 shows a projected plan view of the print head 50.

In the print head 50 shown in FIG. 3, pressure chamber units 54 constituted by a nozzle 51 which ejects ink in the form of liquid droplets, a pressure chamber 52 which applies pressure to the ink during ink ejection, and an ink supply port 53 which supplies ink to the pressure chamber 52 from a common liquid chamber, not shown in FIG. 3, are arranged in a two-dimensional matrix form.

In the example shown in FIG. 3, each pressure chamber 52 takes a substantially square planar form when seen from above. The nozzle 51 is formed at one end of the diagonal of the pressure chamber unit 54, and the ink supply port 53 is provided at the other end. In FIG. 3, the planar form of each pressure chamber 52 when seen from above is substantially square, but in the present invention, the planar form of the pressure chamber 52 is not limited to this square shape.

Figure 4:
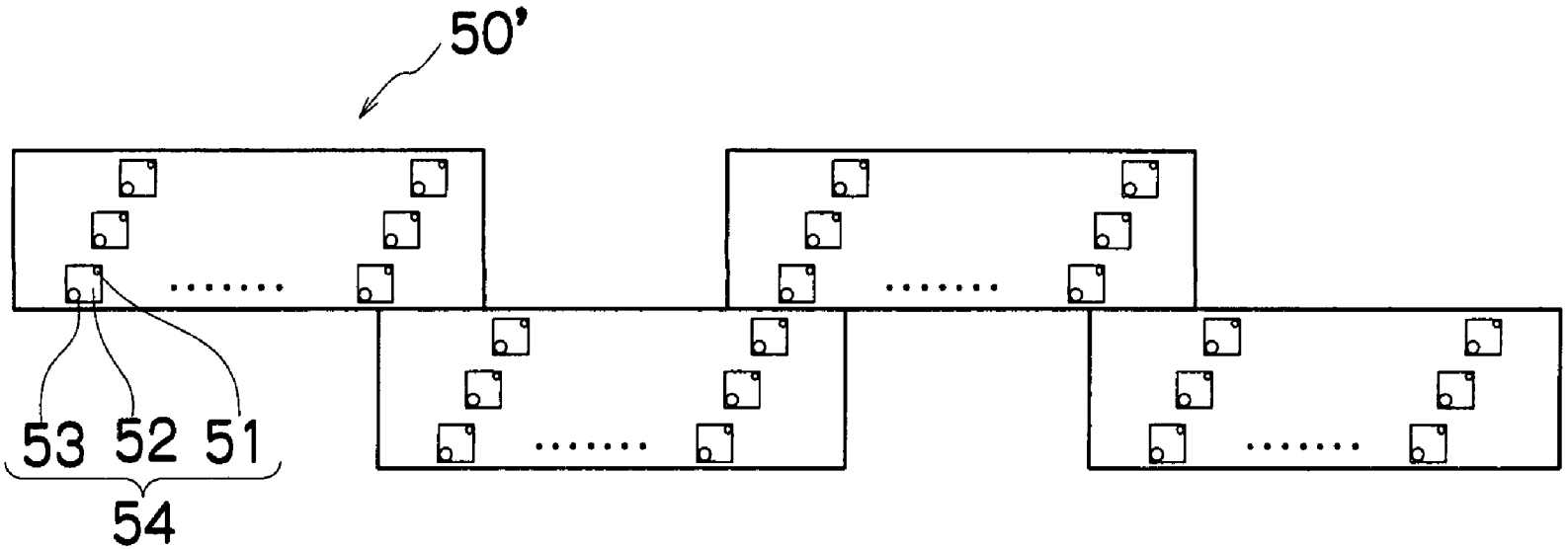
FIG. 4 is a plan view showing another example of a print head.

FIG. 4 is a projected plan view showing a structural example of another print head. As shown in FIG. 4, a plurality of short heads 50' may be arranged two-dimensionally in zigzag form and connected such that the plurality of short heads 50' form a single, elongated full-line head having an overall length which corresponds to the entire width of the print medium.

Figure 5:
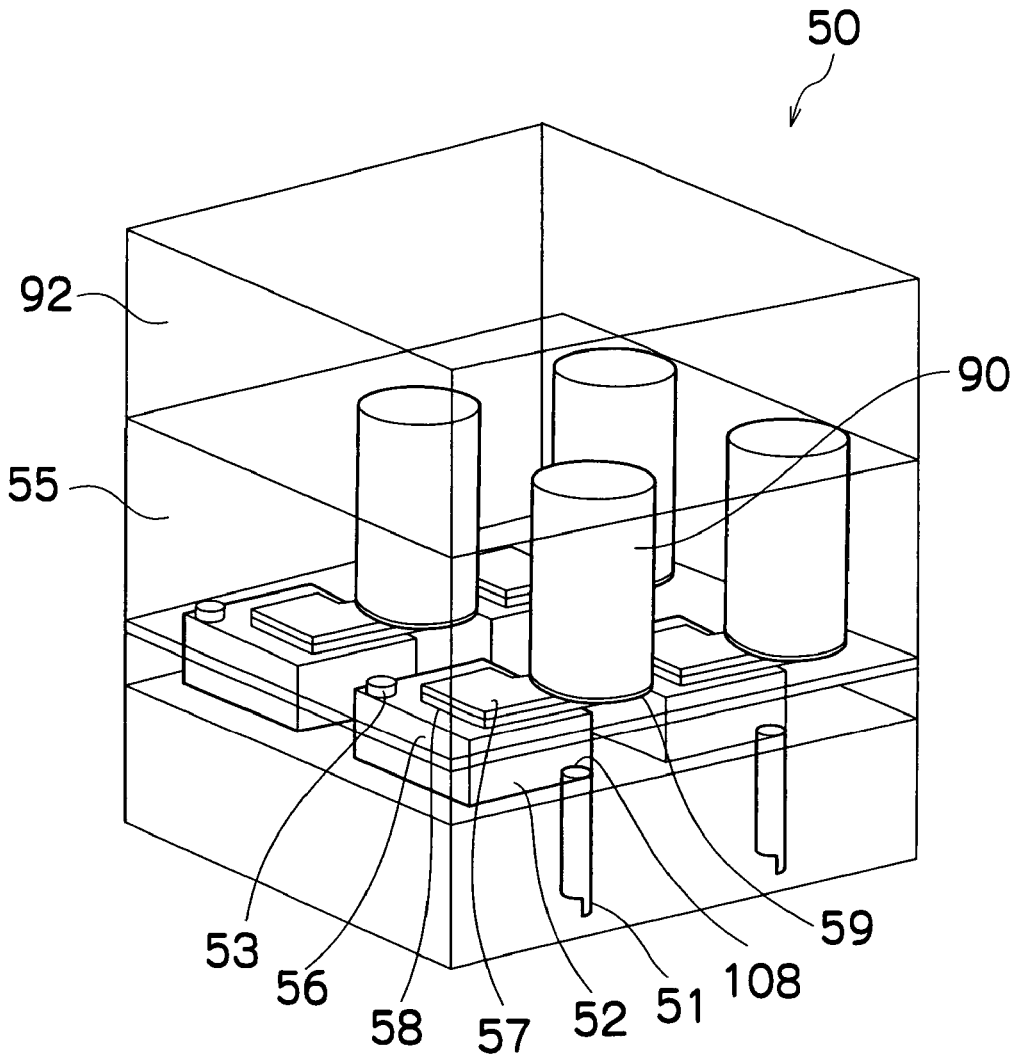
FIG. 5 is a projected perspective view showing a simplification of a part of the print head.

FIG. 5 is a projected perspective view of a simplification of a part of the print head 50 for illustrating the basic constitution of the print head 50.

In the print head 50 shown in simplified form in FIG. 5, a diaphragm 56 is disposed on the pressure chamber 52, which applies pressure to the ink when the ink is to be ejected, and a piezoelectric element 58, serving as a pressure generating device and constituted by a piezoelectric body such as a piezo, is disposed on the diaphragm 56. The diaphragm 56 transmits the pressure generated by the piezoelectric element 58 to the pressure chamber 52. The diaphragm 56 also constitutes one of the electrodes (a common electrode) which sandwich the piezoelectric element 58. An individual electrode 57 disposed directly above the piezoelectric element 58 constitutes the other electrode corresponding to the diaphragm 56.

An electrode pad 59 serving as an electrode connection unit is drawn outside from an end face of the individual electrode 57, and a columnar electric wire 90 is formed substantially perpendicular to the surface on which the piezoelectric element 58 is disposed (in the print head 50 shown in FIG. 5, the upper surface of the diaphragm 56) so as to stand upright from the electrode pad 59. The electric wire 90, which stands upright in columnar form, is also known as an electric column due to its shape. A multi-layer flexible cable 92 is disposed on the electric wire 90, and drive signals are supplied from the flexible cable 92 to the piezoelectric element 58 via the electric wire 90 and individual electrode 57.

The space in which the electric wires 90 stand side by side between the diaphragm 56 and flexible cable 92 serves as a common liquid chamber 55 for supplying ink to each pressure chamber 52 via each ink supply port 53. Thus the electric wires 90 support the flexible cable 92 from below, and form the space which serves as the common liquid chamber 55. To put it another way, the electric wires 90 (electric columns) are formed to stand upright within the common liquid chamber 55, and pass through the common liquid chamber 55.

The columnar electric wire 90 in this case supports the multi-layer flexible cable 92 from below, but instead of the multi-layer flexible cable 92, an IC (Integrated Circuit) chip which drives the piezoelectric element 58 may be connected directly to the columnar electric wire 90. Although not shown in the drawing, the ceiling of the common liquid chamber 55 is constituted by an insulating protective film (ceiling plate). When a driving IC chip is connected directly to the columnar electric wire 90, the driving IC chip is disposed on the ceiling plate of the common liquid chamber 55.

Further, here one electric wire 90 is formed in relation to each piezoelectric element 58, but in order to reduce the number of wires (the number of electric columns), a single electric wire 90 may be provided for a plurality of piezoelectric elements 58 so that one electric wire 90 corresponds to several piezoelectric elements 58. Moreover, the wire for the common electrode (diaphragm 56) may also be formed as the electric wire 90, as well as the wire for the individual electrode 57.

Further, the common liquid chamber 55 shown here is formed as a single large space over the entire area in which the pressure chambers 52 are formed so that ink can be supplied to all of the pressure chambers 52 shown in FIG. 3. However, the common liquid chamber 55 is not limited to being formed as a single space in this manner, and may be formed as a plurality of common liquid chambers 55 divided into several areas.

As shown in FIG. 5, an opening portion 108 which communicates with the nozzle 51 is formed in the bottom face of the pressure chamber 52, and the ink supply port 53, which communicates with the common liquid chamber 55, is provided on the upper face side of the pressure chamber 52 in the corner portion that is diagonally opposite to the opening portion 108 in the bottom face. The ink supply port 53 passes through the diaphragm 56 such that the common liquid chamber 55 and pressure chamber 52 communicate directly via the ink supply port 53. As a result, the common liquid chamber 55 and pressure chamber 52 have a direct fluid connection.

The diaphragm 56 is formed by a single plate shared by each pressure chamber 52. The piezoelectric element 58 for deforming the pressure chamber 52 is disposed in the parts of the diaphragm 56 that correspond to each of the pressure chambers 52. The electrodes (common electrode and individual electrode) for driving the piezoelectric element 58 by applying pressure thereto are formed on the upper and lower surfaces of the piezoelectric element 58 so as to sandwich the piezoelectric element 58.

Although not shown in FIG. 5, the common liquid chamber 55 is filled with ink, and therefore the ink-contacting surfaces of the diaphragm 56 serving as the common electrode, the individual electrode 57, the electric wire 90, and the flexible cable 92 are all covered with an insulating protective film.

Further, although not shown in FIG. 5, an insulating film is formed between the diaphragm 56 and electrode pad 59.

There are no particular limitations on the various dimensions of the print head 50 described above, but to provide an example, the pressure chamber 52 has a substantially square-shaped planar form of 300 μm×300 μm (the angles have been rounded to eliminate ink flow stagnation points) and a height of 150 μm, the diaphragm 56 and piezoelectric element 58 each have a thickness of 10 μm, the diameter of the electric wire 90 (electric column) at the connecting portion with the electrode pad 59 is 100 μm, the height of the electric wire 90 is 500 μm, and so on.

The specific constitution of the print head 50 serving as an embodiment of the liquid ejection head according to the present invention will now be described in detail.

Figure 6:
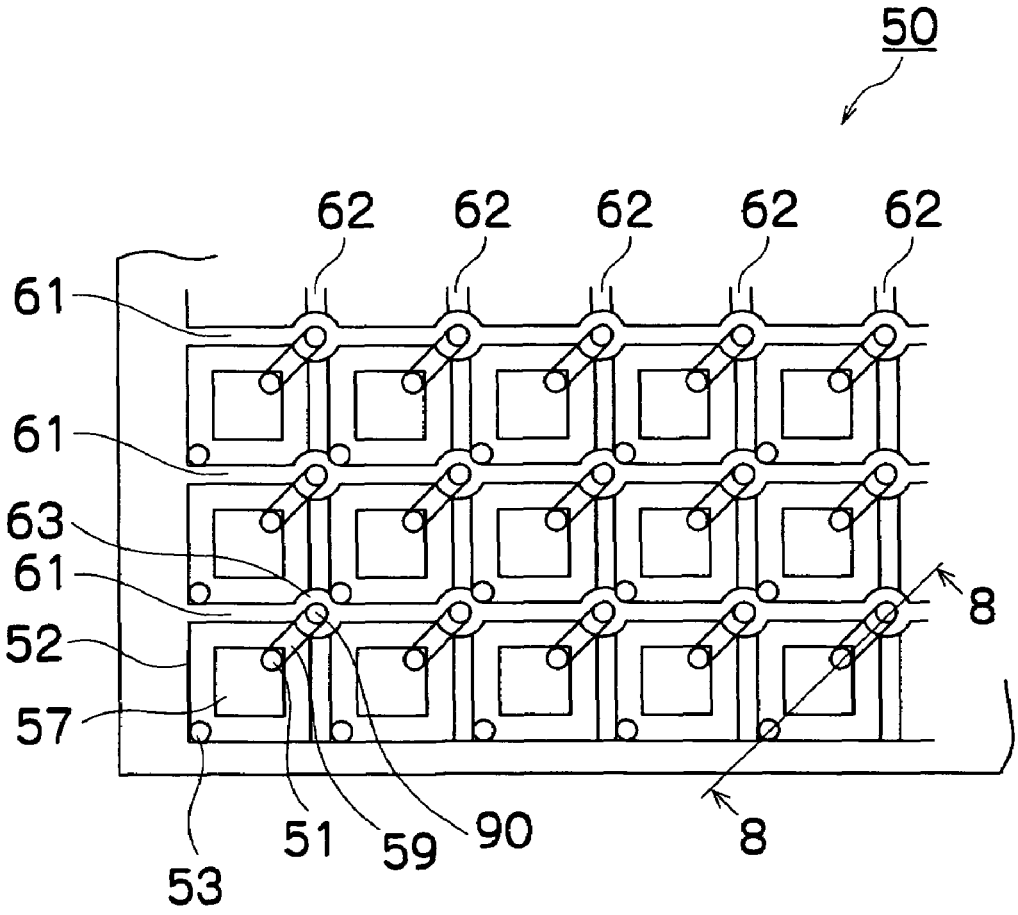
FIG. 6 is a projected plan view showing a part of the print head of a first embodiment.

FIG. 6 is a projected plan view showing a part of the print head 50 according to a first embodiment of the present invention.

As will be described in detail below, the print head 50 shown in FIG. 6 is formed by laminating a plurality of plate members of various types onto a core substrate (also referred to as "glass epoxy substrate") constituted by glass epoxy resin.

As described above, the columnar electric wire 90 is connected to the individual electrode 57 via the electrode pad 59. To form the electric wire 90, a plurality of first wiring plates 61 having a strip form and disposed in the horizontal direction in FIG. 6, and a plurality of second wiring plates 62 having a strip form and disposed in the vertical direction in FIG. 6, are laminated together alternately so as to intersect at right angles on different levels, thus forming a stepped, matrix-form laminated structure. The wiring plates 61, 62 are laminated together so as to be disposed between the pressure chambers 52. The electric wires 90 are formed in parts 63 at which the first wiring plates 61 and second wiring plates 62 intersect on different levels. The wiring plates 61, 62 shown in FIG. 6 are omitted from FIG. 5, which shows a simplification of the print head 50.

Figure 7:
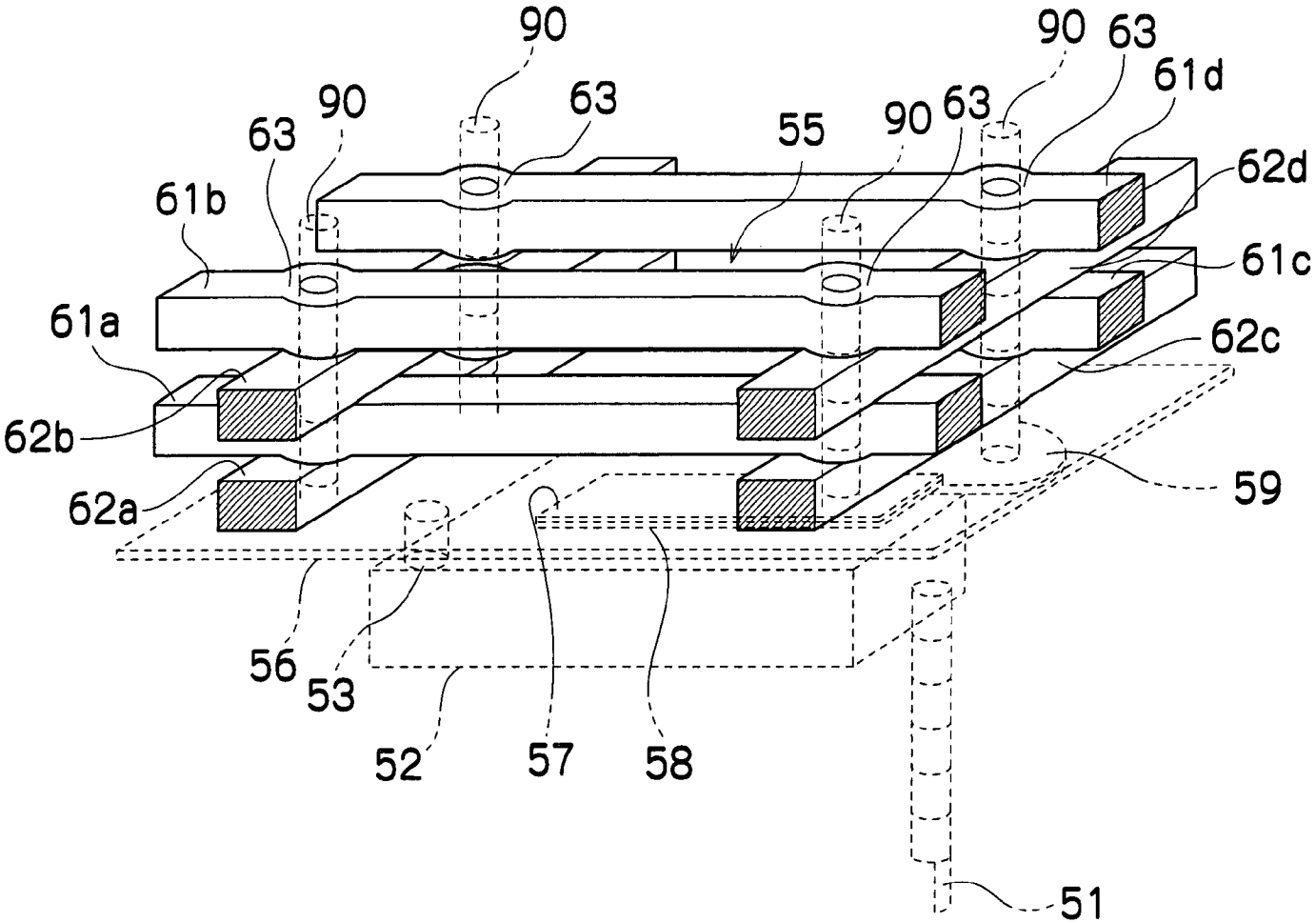
FIG. 7 is a perspective view showing a part of a laminated structure in a liquid supply chamber of the print head.

A part of the stepped, matrix-form laminated structure constituted by the wiring plates 61, 62 is shown in the perspective view in FIG. 7 to facilitate understanding of the structure. FIG. 7 shows a part of the laminated structure in which four first wiring plates 61 (61*a*, 61*b*, 61*c*, 61*d*) and four second wiring plates 62 (62*a*, 62*b*, 62*c*, 62*d*) are laminated alternately within the common liquid chamber 55 in relation to one piezoelectric element 58 (or one pressure chamber 52). As shown in FIG. 7, the wiring plates 61, 62 are laminated to form a stepped lattice around one piezoelectric element 58 (or one pressure chamber 52).

In a perpendicular direction to the disposal surface of the piezoelectric element 58 (the upper surface of the diaphragm 56 in FIG. 7), gaps between the first wiring plates 61 (in FIG. 7, the gap between the wiring plate denoted by the reference symbol 61*a* and the wiring plate denoted by the reference symbol 61*b*, and the gap between the wiring plate denoted by the reference symbol 61*c* and the wiring plate denoted by the reference symbol 61*d*), gaps between the second wiring plates 62 (in FIG. 7, the gap between the wiring plate denoted by the reference symbol 62*a* and the wiring plate denoted by the reference symbol 62*b*, and the gap between the wiring plate denoted by the reference symbol 62*c* and the wiring plate denoted by the reference symbol 62*d*), the gap between the wiring plates 62*b*, 62*d* and the ceiling of the common liquid chamber 55, and the gap between the wiring plates 61*a*, 61*c* and the bottom face of the common liquid chamber 55, are formed within the common liquid chamber 55. In other words, a plurality of flow passages, each having a rectangular opening cross-section, are formed in the common liquid chamber 55. When the common liquid chamber 55 itself is considered as a single flow passage (common flow passage), it may be said that the plurality of flow passages formed by the laminated structure of the wiring plates 61, 62 constitutes a part of the common flow passage.

By means of this stepped, lattice-form laminated structure (which is a stepped, matrix-form laminated structure in terms of the entire print head 50), the print head 50 is increased in rigidity, and an ink flow can be generated within the common liquid chamber 55.

Figure 8:
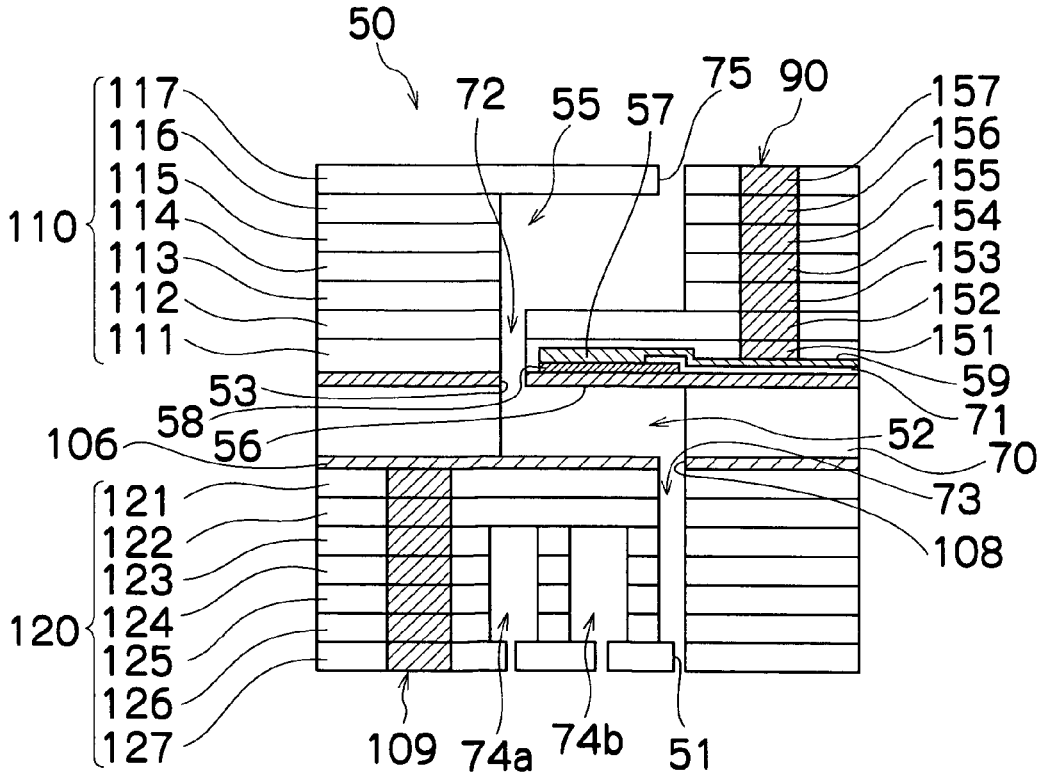
FIG. 8 is a sectional view along a line 8-8 in FIG. 6.

To illustrate the print head 50 shown in FIG. 6 in further detail, FIG. 8 shows a sectional view thereof along a line 8-8 in FIG. 6.

In FIG. 8, a core substrate 70 constituted by glass epoxy resin is disposed in the central portion of the cross-section of the print head 50. Glass epoxy resin (also known as "glass fabric-based epoxy resin") is a type of coated paper textile in which resin is filled into a paper textile constituted by fibers. More specifically, glass epoxy resin is a material formed by filling epoxy resin into a glass fabric serving as a base material.

The core substrate 70 made from this coated paper textile is disposed in the central portion of the cross-section of the print head 50, and the pressure chamber 52 is formed within the core substrate 70. In so doing, the print head 50 is increased in rigidity.

Examples of the fibers that may be used as the base material of the core substrate 70 include firstly, ceramic fibers such as glass fibers, secondly, synthetic fibers made from oil and so on, thirdly, natural fibers such as plant fibers and animal fibers existing in the natural world, and fourthly, chemical fibers produced by subjecting natural fibers to chemical processing. The paper textile may be woven or non-woven, depending on the forming method employed. A thermosetting resin having a structure in which macromolecules are cross-linked following curing is typically used as the resin coating. A polyimide resin may be used instead of an epoxy resin.

The print head 50 of this embodiment is formed by laminating various types of plates onto the upper side and lower side of the core substrate 70 constituted by glass epoxy resin. The diaphragm 56, piezoelectric element 58, individual electrode 57, electric wire 90, common liquid chamber 55, and an individual supply flow passage 72 are formed on the upper side of the core substrate 70, and the nozzle 51 and an individual ejection flow passage 73 are formed on the lower side of the core substrate 70. The individual supply flow passage 72 connects the common liquid chamber 55 to the pressure chamber 52, and the individual ejection flow passage 73 connects the pressure chamber 52 to the nozzle 51. Further, to ensure that the upper and lower sides of the core substrate 70 have a substantially identical structure, a pseudo-diaphragm 106 of a thin plate corresponding to the diaphragm 56, a pseudo-electric wire 109 corresponding to the electric wire 90, and pseudo-spaces 74*a*, 74*b* communicating with the outside (atmosphere), are formed on the lower side of the core substrate 70.

More specifically, the diaphragm 56, and a first laminated resin layer portion 110 comprising seven resin layers 111 through 117, are formed on the upper side of the core substrate 70, and so that the structure on the lower side of the core substrate 70 is substantially identical to the structure on the upper side, the pseudo-diaphragm 106, and a second laminated resin layer portion 120 comprising seven resin layers 121 through 127, are formed on the lower side of the core substrate 70.

Here, a substantially identical structure indicates that in the vertical section of the print head 50 centering on the core substrate 70 (using the core substrate 70 as a reference), the area ratio of the space portions (the common liquid chamber 55, individual supply flow passage 72, individual ejection flow passage 73, and so on) is substantially identical between the opposing layers on the upper side and lower side of the core substrate 70. In other words, the area ratio of the opposing layers on the upper and lower sides of the core substrate 70, excluding the space portions, is identical. In this embodiment, the area ratio of the wiring portions (the electric wire 90, pseudo-electric wire 109, and so on) is also substantially identical between the opposing layers on the upper and lower sides of the core substrate 70.

The area ratio may be expressed as a percentage of the ratio between the surface area of each laminated layer, including the space portions, and the space portions or wiring portions.

The expression "the area ratio is substantially identical" is not limited to a case in which the area ratio is perfectly matched on the upper and lower sides, and includes cases in which the area ratio on the upper and lower sides differs by up to approximately 10%, taking into account restrictions caused by finishing precision, design restrictions, and so on.

By forming the upper side and lower side of the core substrate 70 with substantially identical structures, warping of the print head 50 is prevented.

This substantially identical structure based on the core substrate 70 will now be described in further detail.

The diaphragm 56 is laminated onto the upper face of the core substrate 70 in which the pressure chamber 52 is formed. In other words, the ceiling (upper face) of the pressure chamber 52 is constituted by the diaphragm 56, which is formed from a thin film. Meanwhile, the thin film 106 (pseudo-diaphragm) having a substantially identical thickness to the diaphragm 56 is laminated onto the lower face of the core substrate 70 in which the pressure chamber 52 is formed.

The opening portion 53 (ink supply port) constituting a part of the individual supply flow passage 72 is provided in the diaphragm 56, and an opening portion 108 constituting a part of the individual ejection flow passage 73 is provided in the pseudo-diaphragm 106. The opening area of the opening portion 108 provided in the pseudo-diaphragm 106 is substantially identical to the opening area of the opening portion 53 provided in the diaphragm 56. In other words, the pseudo-diaphragm 106 corresponding to the diaphragm 56 has a substantially identical area ratio to that of the diaphragm 56.

The seven resin layers 111, 112, 113, 114, 115, 116, 117 are laminated onto the upper side of the core substrate 70. Likewise, the seven resin layers 121, 122, 123, 124, 125, 126, 127 are laminated onto the lower side of the core substrate 70. In other words, the same number of resin layers is laminated onto the upper and lower sides of the core substrate 70.

Here, the resin used for the laminated layers is a thermosetting resin having an insulating property and good liquid-resistance. Moreover, a resin further having photosensitivity is used so that photo-etching can be performed.

The resin layers 111 through 117 (upper side resin layers) laminated onto the upper side of the core substrate 70 are known as the "first upper side resin layer" 111, "second upper side resin layer" 112, "third upper side resin layer" 113, "fourth upper side resin layer" 114, "fifth upper side resin layer" 115, "sixth upper side resin layer" 116, and "seventh upper side resin layer" 117, in order from the resin layer positioned closest to the core substrate 70, and the resin layers 121 through 127 (lower side resin layers) laminated onto the lower side of the core substrate 70 are known as the "first lower side resin layer" 121, "second lower side resin layer" 122, "third lower side resin layer" 123, "fourth lower side resin layer" 124, "fifth lower side resin layer" 125, "sixth lower side resin layer" 126, and "seventh lower side resin layer" 127, in order from the resin layer positioned closest to the core substrate 70.

The opposing resin layers on the upper and lower sides of the core substrate 70 are laminated at a substantially identical thickness. More specifically, the first upper side resin layer 111 and first lower side resin layer 121 have a substantially identical thickness, the second upper side resin layer 112 and second lower side resin layer 122 have a substantially identical thickness, the third upper side resin layer 113 and third lower side resin layer 123 have a substantially identical thickness, the fourth upper side resin layer 114 and fourth lower side resin layer 124 have a substantially identical thickness, the fifth upper side resin layer 115 and fifth lower side resin layer 125 have a substantially identical thickness, the sixth upper side resin layer 116 and sixth lower side resin layer 126 have a substantially identical thickness, and the seventh upper side resin layer 117 and seventh lower side resin layer 127 have a substantially identical thickness.

FIG. 8 shows a case in which all of the resin layers 111 through 117 and 121 through 127 have an identical thickness so as to appear uniform in the vertical direction of the drawing, but the present invention is not limited to this aspect, and as long as the opposing resin layers on the upper and lower sides of the core substrate 70 have a substantially identical thickness, the thickness of different layers may differ. For example, the first upper side resin layer 111 may be thicker than the second upper side resin layer 112.

An opening portion (with no reference numeral) constituting a part of the individual supply flow passage 72 is formed in each of the first upper side resin layer 111 and second upper side resin layer 112. Meanwhile, an opening portion (with no reference numeral) constituting a part of the individual ejection flow passage 73 is formed in each of the lower side resin layers from the first lower side resin layer 121 to the sixth lower side resin layer 126.

Further, an opening portion (with no reference numeral) constituting a part of the common liquid chamber 55 is formed in each of the upper side resin layers from the third upper side resin layer 113 to the sixth upper side resin layer 116. Meanwhile, an opening portion (with no reference numeral) constituting a part of the pseudo-spaces 74*a* and 74*b* provided in a dispersed plurality is formed in each of the lower side resin layers from the third lower side resin layer 123 to the sixth lower side resin layer 126. By dispersing a plurality of the pseudo-spaces in this manner, stress on the laminated resin layers can be alleviated.

The sum of the opening area of the pseudo-spaces 74*a*, 74*b* provided in the lower side of the core substrate 70 and the opening area of the individual ejection flow passage 73 is substantially identical to the opening area of the common liquid chamber 55 provided in the upper side of the core substrate 70.

Conductive layers 151, 152, 153, 154, 155, 156, 157 constituting apart of the electric wire 90 are laminated onto the first upper side resin layer 111 through seventh upper side resin layer 117 respectively. Meanwhile, conductive layers (with no reference numeral) constituting a part of the pseudo-electric wire 109 corresponding to the electric wire 90 are laminated onto the first lower side resin layer 121 through seventh lower side resin layer 127 respectively.

The sectional area of the pseudo-electric wire 109 disposed on the lower side of the core substrate 70 is substantially identical to the sectional area of the electric wire 90 disposed on the upper side of the core substrate 70.

Further, an opening portion 75 is formed in the seventh upper side resin layer 117, and an opening portion constituting the nozzle 51 is formed in the seventh lower side resin layer 127.

Next, an example (first example) of a manufacturing method for the print head 50 of the first embodiment, shown in FIG. 8, will be described using FIGS. 9A to 9E, 10A to 10D, and 11A to 11D.

FIGS. 9A to 9E mainly show a manufacturing process for forming the pressure chamber 52 and diaphragm 56, while FIGS. 10A to 10D and FIGS. 11A to 11D mainly show a manufacturing process for laminating the resin layers (111 to 117 and 121 to 127) and forming the common liquid chamber 55 and electric wire 90.

Figure 9A:
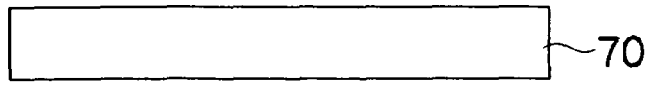
FIGS. 9A to 9E are first illustrative views used to illustrate an example of a manufacturing process of the print head according to the first embodiment.

First, as shown in FIG. 9A, the core substrate 70 (glass epoxy substrate) made of glass epoxy resin is prepared.

Figure 9B:
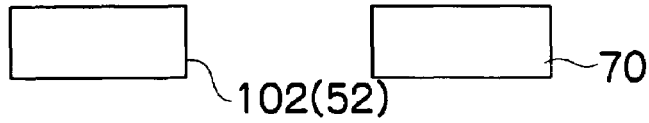

Next, as shown in FIG. 9B, an opening portion 102 constituting the pressure chamber 52 is formed in the core substrate 70 through a hole-boring process. In the hole-boring process, laser processing or the like is employed to form a narrow hole or recess.

Figure 9C:
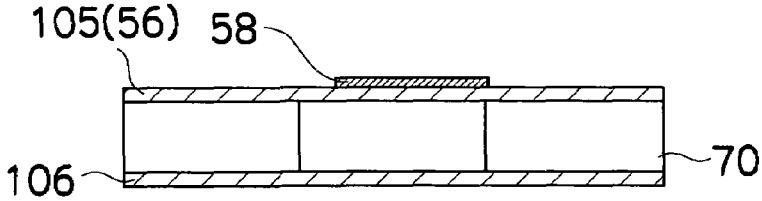

Next, as shown in FIG. 9C, a thin film 105 constituting the diaphragm 56 is laminated onto the upper face of the core substrate 70, and at the same time, the thin film 106 corresponding to the diaphragm 56 is laminated onto the lower face of the core substrate 70. Here, the two thin films 105, 106 are formed with a substantially identical thickness. The piezoelectric element 58, which is manufactured separately, is also disposed on the upper side of the core substrate 70.

Figure 9D:
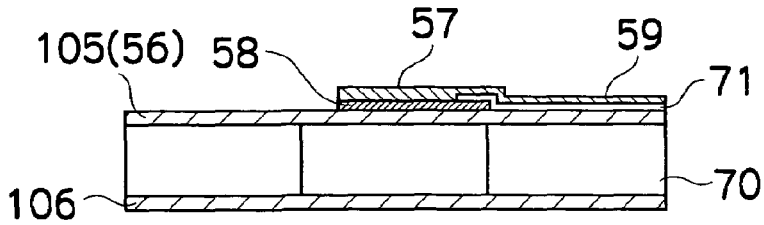

Next, as shown in FIG. 9D, an insulating film 71, the individual electrode 57, and the electrode pad 59 are formed on the upper side of the core substrate 70.

Figure 9E:
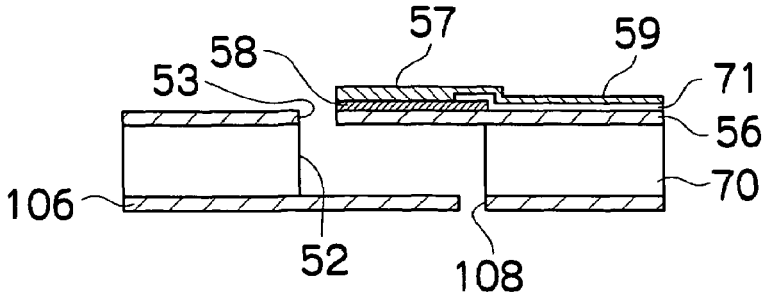

Next, as shown in FIG. 9E, the opening portion 53 constituting a part of the individual supply flow passage 72 is formed in the thin film 105 constituting the diaphragm 56 on the upper side of the core substrate 70, and the opening portion 108 constituting a part of the individual ejection flow passage 73 is formed in the thin film 106 corresponding to the diaphragm 56 on the lower side of the core substrate 70. The two opening portions 53 and 108 are formed with a substantially identical opening area.

Figure 10A:
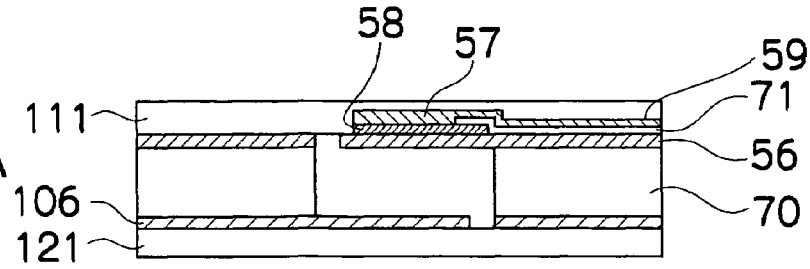
FIGS. 10A to 10D are second illustrative views used to illustrate an example of the manufacturing process of the print head according to the first embodiment.

Next, as shown in FIG. 10A, the resin thin film (first upper side resin layer) 111 is laminated onto the upper side of the core substrate 70, and at the same time, the resin thin film (first lower side resin layer) 121 is laminated onto the lower side of the core substrate 70.

Here, the laminated resin is a thermosetting resin, and the resin thin films on the upper and lower sides of the core substrate 70 are cured (subjected to heat treatment) simultaneously.

Figure 10B:
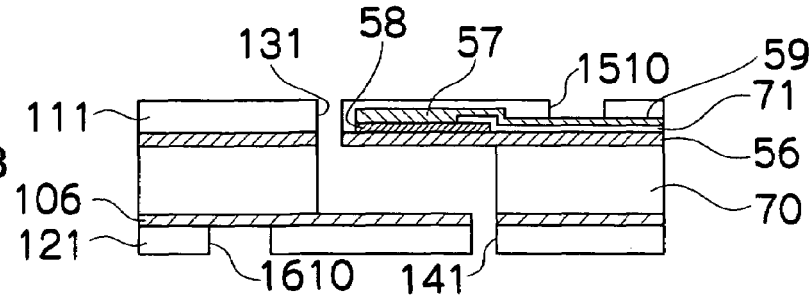

Next, as shown in FIG. 10B, an opening portion 131 constituting a part of the individual supply flow passage 72 is formed in the first resin layer 111 on the upper side of the core substrate 70, and an opening portion 141 constituting a part of the individual ejection flow passage 73 is formed in the first resin layer 121 on the lower side of the core substrate 70. The two opening portions 131 and 141 are formed with a substantially identical opening area.

Further, as shown in FIG. 10B, an opening area 1510 serving as an area for forming the electric wire 90 at a later stage is formed in the first resin layer 111 on the upper side of the core substrate 70, and an opening area 1610 serving as an area for forming the pseudo-electric wire 109 at a later stage is formed in the first resin layer 121 on the lower side of the core substrate 70. The two opening portions 1510 and 1610 are formed with a substantially identical opening area. In other words, the opening portions 1510, 1610 are formed such that the sectional area of the electric wire 90 and the sectional area of the pseudo-electric wire 109 are substantially identical when a conductive material is filled into the opening portions 1510, 1610 at a later stage.

Opening portions are formed in the resin layers by photolithography using a photosensitive resin as the resin, for example.

Figure 10C:
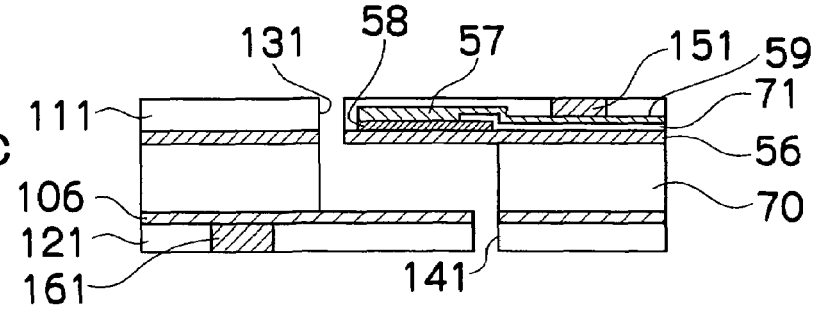

Next, as shown in FIG. 10C, a conductive material is filled into the opening portion 1510 for the electric wire 90 on the upper side of the core substrate 70, and a conductive material is filled into the opening portion 1610 for the pseudo-electric wire 109 on the lower side of the core substrate 70. In other words, the first upper side conductive layer 151 forming a part of the electric wire 90 is laminated onto the upper side of the core substrate 70, and a first lower side conductive layer 161 forming a part of the pseudo-electric wire 109 is laminated onto the lower side of the core substrate 70.

The wiring portions are formed by a method such as printing or plating using a conductive material such as Au, Cu, or another metal, or a conductive adhesive, for example.

Figure 10D:
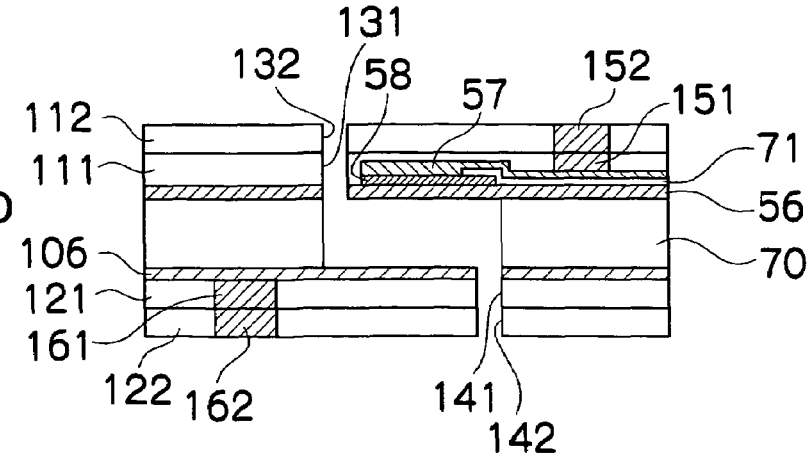

By repeating the processes of FIGS. 10A, 10B, and 10C one more time, the structure shown in FIG. 10D is formed. More specifically, similarly to FIG. 10A, the second resin layer 112 is laminated onto the upper side of the core substrate 70, and at the same time, the second resin layer 122 is laminated onto the lower side of the core substrate 70. Then, similarly to FIG. 10B, an opening portion 132 for the individual supply flow passage 72 and an opening portion (not shown in the drawing) for the electric wire 90 are formed in the second resin layer 112 on the upper side of the core substrate 70, and an opening portion 142 for the individual ejection flow passage 73 and an opening portion (not shown in the drawing) for the pseudo-electric wire 109 are formed in the second resin layer 122 on the lower side of the core substrate 70. Then, similarly to FIG. 10C, a conductive material is filled into the opening portion for the electric wire 90 on the upper side of the core substrate 70 to form the second conductive layer 152 for the electric wire 90, and a conductive material is filled into the opening portion for the pseudo-electric wire 109 on the lower side of the core substrate 70 to form a second conductive layer 162 for the pseudo-electric wire 109.

Here, the opposing thin films on the upper and lower sides of the core substrate 70 are cured simultaneously. Further, the opening portion 132 (constituting a part of) the individual supply flow passage 72 on the upper side of the core substrate 70 and the opening portion 142 for the individual ejection flow passage 73 on the lower side of the core substrate 70 are formed with a substantially identical opening area. Also, the second conductive layer 152 for the electric wire 90 on the upper side of the core substrate 70 and the second conductive layer 162 for the pseudo-electric wire 109 on the lower side of the core substrate 70 are formed with a substantially identical sectional area.

As shown in FIG. 10D, a case has been described above in which only two resin layers are laminated onto the upper side and lower side of the core substrate 70, but as long as the resin layers are laminated onto the upper side and lower side of the core substrate 70 simultaneously, a number of resin layers other than two may be laminated as appropriate.

Figure 11A:
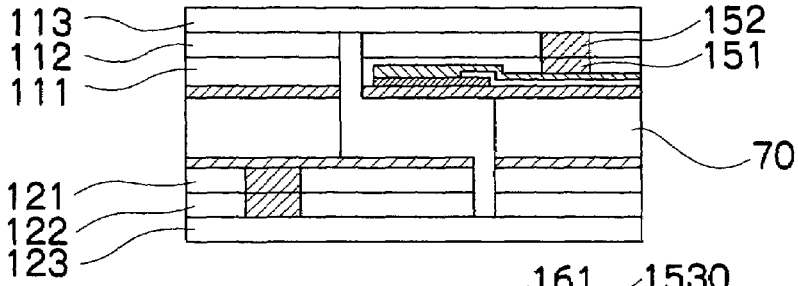
FIGS. 11A to 11D are third illustrative views used to illustrate an example of the manufacturing process of the print head according to the first embodiment.

Next, as shown in FIG. 11A, the resin thin film (third upper side resin layer) 113 is laminated onto the upper side of the core substrate 70, and at the same time, the resin thin film (third lower side resin layer) 123 is laminated onto the lower side of the core substrate 70. The thin films on the upper and lower sides of the core substrate 70 are cured simultaneously.

Figure 11B:
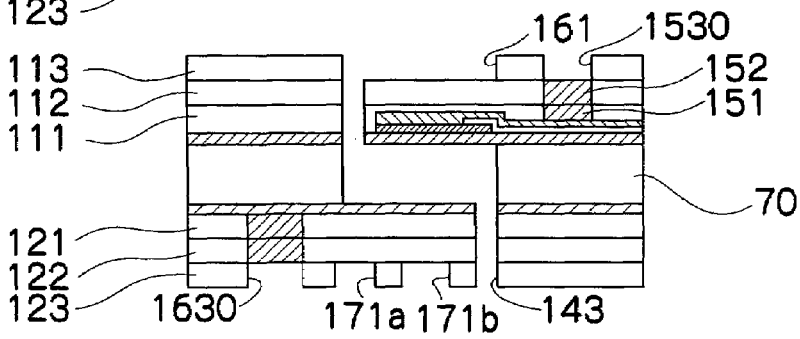

Next, as shown in FIG. 11B, the opening portion 161 constituting a part of the common liquid chamber 55 is formed on the third resin layer 113 on the upper side of the core substrate 70, and an opening portion 171*a* constituting a part of the first pseudo-space 74*a*, an opening portion 171*b* constituting a part of the second pseudo-space 74*b*, and an opening portion 143 constituting a part of the individual ejection flow passage 73, are formed on the third resin layer 123 on the lower side of the core substrate 70. Here, the opening area of the opening portion 161 for the common liquid chamber 55 on the upper side of the core substrate 70 is substantially identical to the total opening area of the opening portions 171*a*, 171*b* for the pseudo-spaces 74*a*, 74*b* and the opening portion 143 for the individual ejection flow passage 73 on the lower side of the core substrate 70.

Further, as shown in FIG. 11B, an opening area 1530 for the electric wire 90 is formed in the third resin layer 113 on the upper side of the core substrate 70, and an opening area 1630 for the pseudo-electric wire 109 is formed in the third resin layer 123 on the lower side of the core substrate 70. The opening portion 1530 for the electric wire 90 on the upper side of the core substrate 70 and the opening portion 1630 for the pseudo-electric wire 109 on the lower side of the core substrate 70 are formed with a substantially identical opening area. In other words, the opening portions 1530, 1630 are formed such that the sectional area of the electric wire 90 and the sectional area of the pseudo-electric wire 109 are substantially identical when a conductive material is filled into the opening portions 1530, 1630 at a later stage.

Figure 11C:
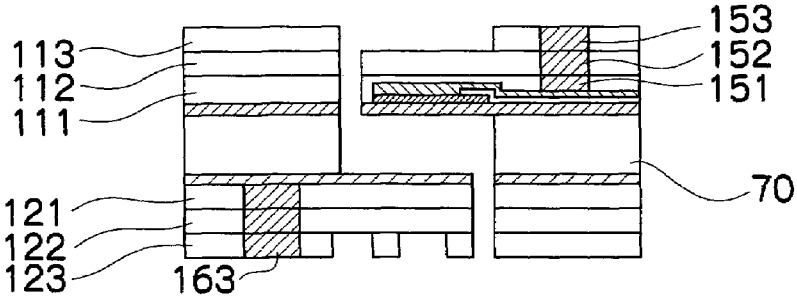

Next, as shown in FIG. 11C, a conductive material is filled into the opening portion 1530 for the electric wire 90 on the upper side of the core substrate 70, and a conductive material is filled into the opening portion 1630 for the pseudo-electric wire 109 on the lower side of the core substrate 70. In other words, the third upper side conductive layer 153 forming a part of the electric wire 90 is laminated onto the upper side of the core substrate 70, and a third lower side conductive layer 163 forming a part of the pseudo-electric wire 109 is laminated onto the lower side of the core substrate 70.

Figure 11D:
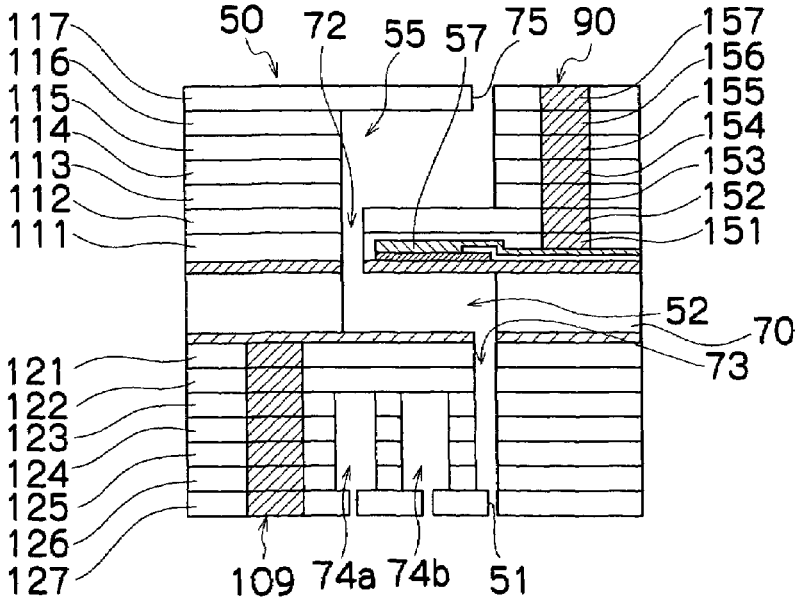

By repeating the processes of FIGS. 11A, 11B, and 11C three more times, laminating the uppermost layer 117 and lowest layer 127 onto the upper and lower sides of the core substrate 70 respectively, and forming the required opening portions 75, 51 therein, the print head 50 shown in FIG. 11D is obtained.

More specifically, the fourth through seventh resin layers 114, 115, 116, 117 are laminated onto the upper side of the core substrate 70, and the fourth through seventh resin layers 124, 125, 126, 127 are laminated onto the lower side of the core substrate 70. Here, as described with reference to FIG. 11A, the corresponding resin layers on the upper side and lower side of the core substrate 70 (the fourth upper side resin layer 114 and fourth lower side resin layer 124, the fifth upper side resin layer 115 and fifth lower side resin layer 125, the sixth upper side resin layer 116 and sixth lower side resin layer 126, and the seventh upper side resin layer 117 and seventh lower side resin layer 127) are formed simultaneously.

An opening portion for the common liquid chamber 55 is formed in each of the fourth through sixth resin layers 114, 115, 116 on the upper side of the core substrate 70. Opening portions for the pseudo-spaces 74*a*, 74*b* and an opening portion for the individual ejection flow passage 73 are formed respectively in the fourth through sixth resin layers 124, 125, 126 on the lower side of the core substrate 70. Here, as described with reference to FIG. 11B, the opening portions are formed with a substantially identical opening area on the upper side and lower side of the core substrate 70. Further, the fourth through seventh conductive layers 154, 155, 156, 157 constituting parts of the electric wire 90 are formed in the fourth through seventh resin layers 114, 115, 116, 117 on the upper side of the core substrate 70, and fourth through seventh conductive layers (with no reference numerals) constituting parts of the pseudo-electric wire 109 are formed in the fourth through seventh resin layers 124, 125, 126, 127 on the lower side of the core substrate 70. Here, as described with reference to FIGS. 11B and 11C, the electric wire 90 and pseudo-electric wire 109 are formed with a substantially identical sectional area on the upper side and lower side of the core substrate 70.

In other words, the print head 50 shown in FIG. 8, having a substantially identical structure on the upper side and lower side of the core substrate 70, is obtained.

When laminating the resin layers using the manufacturing method of the print head 50 described above, the corresponding resin layers on the upper side and lower side of the core substrate 70 in the vertical cross-section of the print head 50 are laminated "simultaneously", thus preventing warping of the laminated structure. By preventing warping, liquid-resistance is ensured in relation to the electric wires 90.

Laminating the resin layers onto the upper and lower sides "simultaneously" is not limited to formation of the resin layers at exactly the same time, and includes a case in which the corresponding resin layers on the upper and lower sides are merely cured (a process of subjecting each resin layer to heat treatment) at the same time.

In the example described above, the corresponding resin layers are laminated onto the upper and lower sides simultaneously in the case of all of the resin layers (111 through 117 and 121 through 127), but the present invention is not limited to a case in which simultaneous lamination is performed in regard to all of the resin layers, and a part of the resin layers in the relative vicinity of the core substrate 70 may be laminated simultaneously onto the upper and lower sides. In regard to the seventh lower side resin layer 127 (nozzle plate), which is the lowest layer, for example, a nozzle plate formed with the nozzles 51 may be manufactured separately and added to the print head 50 as the lowest layer. In this case, the opposing upper and lower layers of the six upper side layers (first upper side resin layer 111 through sixth upper side resin layer 116) and six lower side layers (first lower side resin layer 121 through sixth lower side resin layer 126) are laminated simultaneously. Further, the member constituting the nozzle plate 127 must be made of a material which is sufficiently thin in relation to the laminated resin structure and the core substrate 70, and which has a modulus of elasticity that is sufficiently small in comparison to the modulus of elasticity of the structure prior to the addition of the nozzle plate 127.

Next, another embodiment (second embodiment) of the manufacturing method for the print head 50 according to the first embodiment shown in FIG. 8 will be described using FIGS. 12A to 12F, 13A to 13D, and 14A to 14D.

FIGS. 12A to 12F mainly show a manufacturing process for forming the pressure chamber 52 and diaphragm 56, while FIGS. 13A to 13D and FIGS. 14A to 14D mainly show a manufacturing process for laminating the resin layers (111 to 117 and 121 to 127) and forming the common liquid chamber 55 and electric wire 90.

Figure 12A:
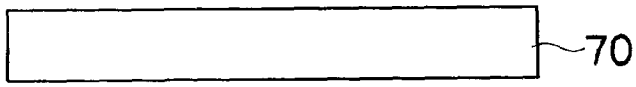
FIGS. 12A to 12F are first illustrative views used to illustrate another example of the manufacturing process of the print head according to the first embodiment.

First, as shown in FIG. 12A, the core substrate 70 (glass epoxy substrate) made of glass epoxy resin is prepared.

Figure 12B:
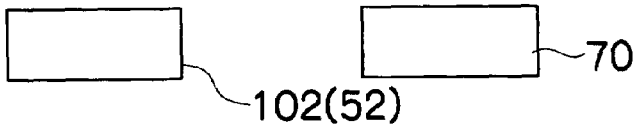

Next, as shown in FIG. 12B, an opening portion 102 is formed in the core substrate 70 through a hole-boring process, thereby forming a space which is to serve as the pressure chamber 52 at a later stage.

Figure 12C:
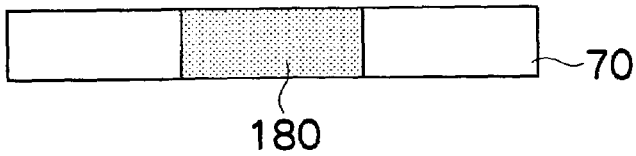

Next, as shown in FIG. 12C, a filling resin (filling material) is filled into the opening portion 102 to be used as the pressure chamber 52 at a later stage. The reference numeral 180 is allocated to the filled space (filled portion).

Figure 12D:
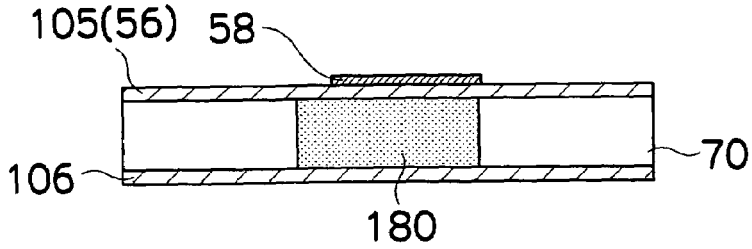

Next, as shown in FIG. 12D, the thin film 105 which will constitute the diaphragm 56 at a later stage is laminated onto the core substrate 70 and filled portion 180, and at the same time, the thin film 106 corresponding to the diaphragm 56 is laminated under the core substrate 70 and filled portion 180. Here, the two thin films 105, 106 are formed with a substantially identical thickness. The piezoelectric element 58, which is manufactured separately, is also disposed on the upper side of the core substrate 70.

Figure 12E:
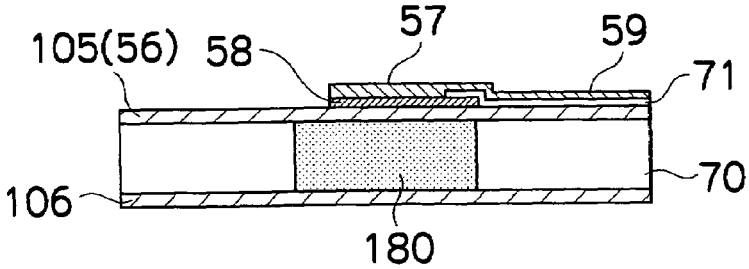

Next, as shown in FIG. 12E, the insulating film 71, individual electrode 57, and electrode pad 59 are formed on the upper side of the core substrate 70.

Figure 12F:
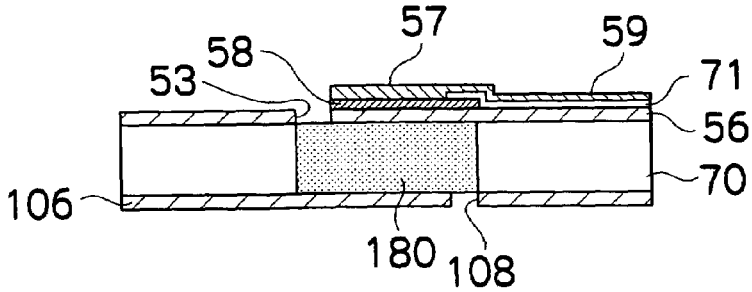

Next, as shown in FIG. 12F, the opening portions 53, 108 having a substantially identical opening area are formed in the thin film 105 for the diaphragm 56 on the upper side of the core substrate 70, and the thin film 106 corresponding to the diaphragm 56 on the lower side of the core substrate 70, respectively.

Figure 13A:
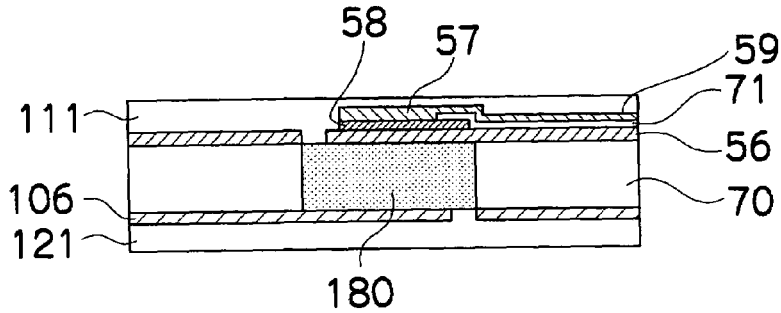
FIGS. 13A to 13D are second illustrative views used to illustrate the other example of the manufacturing process of the print head according to the first embodiment.

Next, as shown in FIG. 13A, the first upper side resin layer 111 and first lower side resin layer 121 are laminated onto the core substrate 70 simultaneously.

Figure 13B:
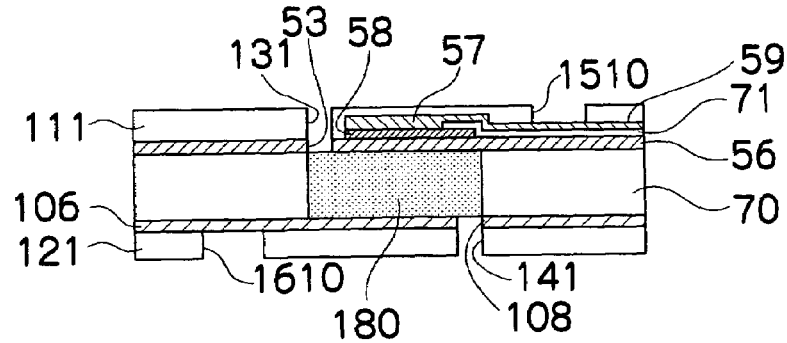

Next, as shown in FIG. 13B, the opening portion 131 for the individual supply flow passage 72 is formed in the first upper side resin layer 111, and the opening portion 141 for the individual ejection flow passage 73 is formed in the first lower side resin layer 121. The two opening portions 131 and 141 are formed with a substantially identical opening area.

Further, as shown in FIG. 13B, the opening area 1510 for the electric wire 90 is formed in the first upper side resin layer 111, and the opening area 1610 for the pseudo-electric wire 109 is formed in the first lower side resin layer 121. The two opening portions 1510 and 1610 are formed with a substantially identical opening area. In other words, the opening portions 1510, 1610 are formed such that the sectional area of the electric wire 90 and the sectional area of the pseudo-electric wire 109 are substantially identical when a conductive material is filled into the opening portions 1510, 1610 at a later stage.

Figure 13C:
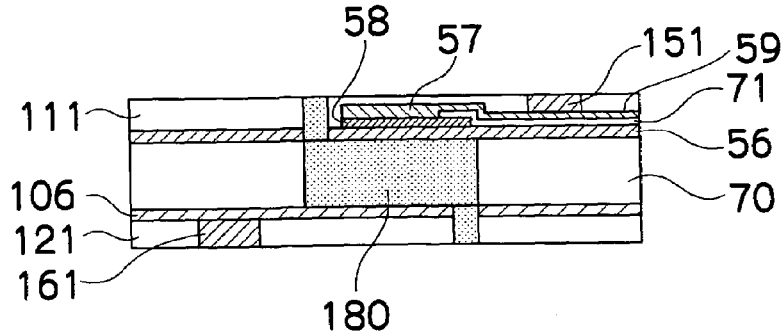

Next, as shown in FIG. 13C, a filling resin (filling material) is filled into the opening portions 53 and 131 for the individual supply flow passage 72, and the opening portions 108 and 141 for the individual ejection flow passage 73. Here, the filling resin is a resin serving as a filling material that is removed at a later stage by dissolution in a predetermined solution, and differs from the non-dissolving resin constituting the resin layers 111, 121.

Further, as shown in FIG. 13C, a conductive material is filled into the opening portion 1510 for the electric wire 90 and the opening portion 1610 for the pseudo-electric wire 109 to form the first conductive layer 151 for the electric wire and the first conductive layer 161 for the pseudo-electric wire.

Figure 13D:
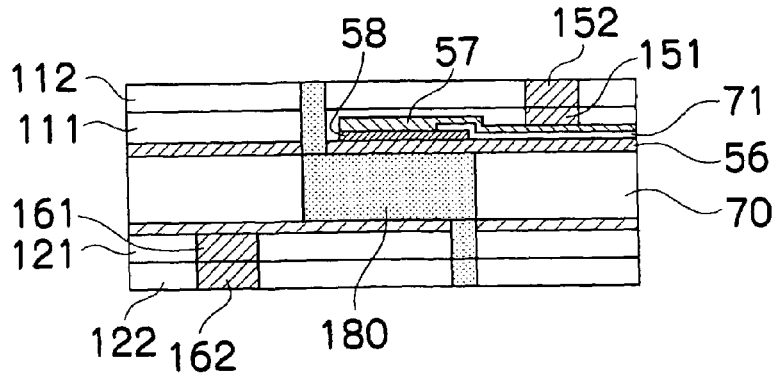

By repeating the processes of FIGS. 13A, 13B, and 13C one more time, the structure shown in FIG. 13D is formed. More specifically, the second upper side resin layer 112 and second lower side resin layer 122 are laminated, the second conductive layer 152 for the electric wire is formed in the second upper side resin layer 112, the second conductive layer 162 for the pseudo-electric wire is formed in the second lower side resin layer 122, and a filling material is filled into the opening portion for the individual supply flow passage 72 in the second upper side resin layer 112 and the opening portion for the individual ejection flow passage 73 in the second lower side resin layer 122.

Figure 14A:
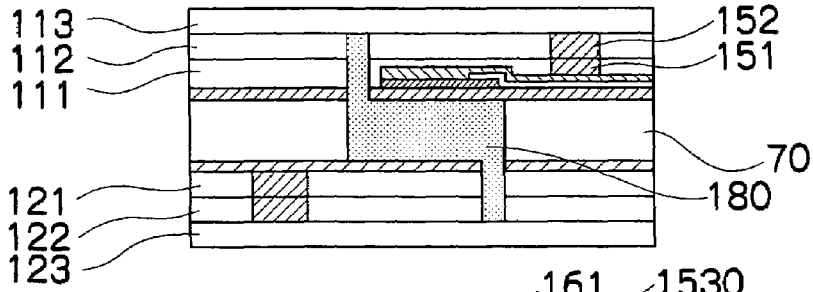
FIGS. 14A to 14D are third illustrative views used to illustrate the other example of the manufacturing process of the print head according to the first embodiment.

Next, as shown in FIG. 14A, the third upper side resin layer 113 and third lower side resin layer 123 are laminated onto the core substrate 70 simultaneously.

Figure 14B:
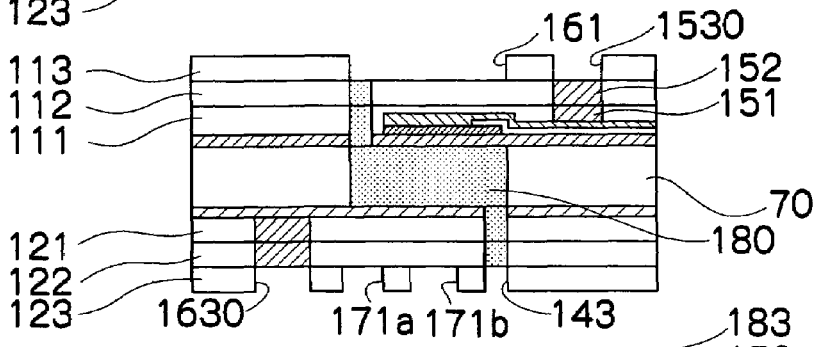

Next, as shown in FIG. 14B, the opening portion 161 for the common liquid chamber 55 is formed in the third upper side resin layer 113, and the opening portions 171*a*, 171*b* for the pseudo-spaces 74*a*, 74*b* and the opening portion 143 for the individual ejection flow passage 73 are formed in the third lower side resin layer 123. Here, the opening area of the opening portion 161 for the common liquid chamber 55 on the upper side of the core substrate 70 is substantially identical to the total opening area of the opening portions 171*a*, 171*b* for the pseudo-spaces 74*a*, 74*b* and the opening portion 143 for the individual ejection flow passage 73 on the lower side of the core substrate 70.

Further, as shown in FIG. 14B, the opening area 1530 for the electric wire 90 is formed in the third upper side resin layer 113, and the opening area 1630 for the pseudo-electric wire 109 is formed in the third lower side resin layer 123. The opening portion 1530 on the upper side of the core substrate 70 and the opening portion 1630 on the lower side of the core substrate 70 are formed with a substantially identical opening area. In other words, the opening portions 1530, 1630 are formed such that the sectional area of the electric wire 90 and the sectional area of the pseudo-electric wire 109 are substantially identical when a conductive material is filled into the opening portions 1530, 1630 at a later stage.

Figure 14C:
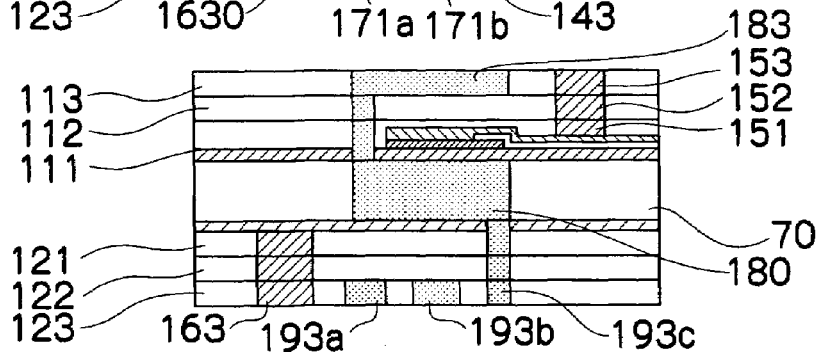

Next, as shown in FIG. 14C, a filling resin (filling material) is filled into the opening portion 161 for the common liquid chamber 55, the opening portions 171*a*, 171*b* for the pseudo-spaces 74*a*, 74*b*, and the opening portion 143 for the individual ejection flow passage 73.

Further, as shown in FIG. 14C, a conductive material is filled into the opening portion 1530 for the electric wire 90 and the opening portion 1630 for the pseudo-electric wire 109. In other words, the third conductive layer 153 for the electric wire 90 and the third conductive layer 163 for the pseudo-electric wire 109 are respectively laminated.

Figure 14D:
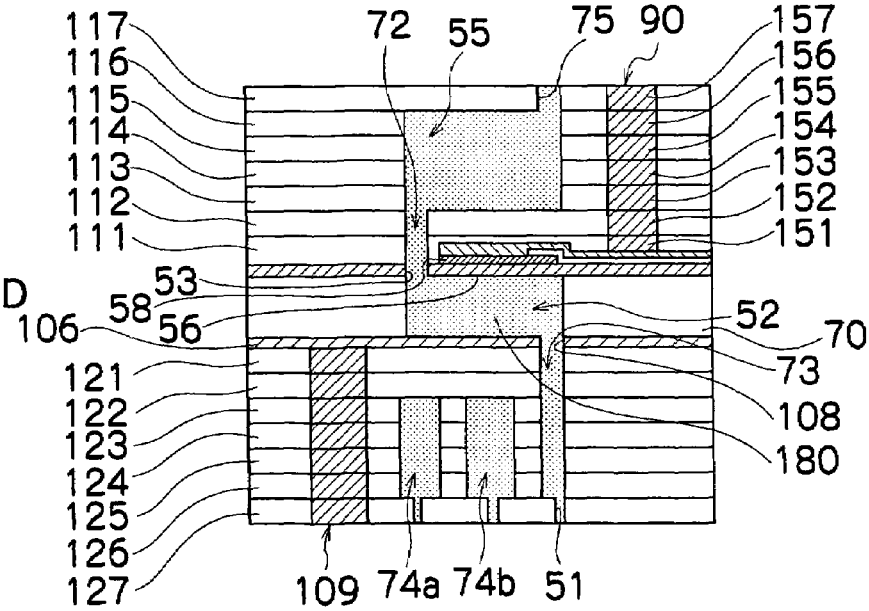

By repeating the processes of FIGS. 14A, 14B, and 14C three more times, then forming the uppermost layer 117 and lowest layer 127, forming the required opening portions therein, and filling these opening portions with filling resin (filling material), the structure shown in FIG. 14D is obtained.

More specifically, the fourth through seventh upper side resin layers 114 to 117 and the fourth through seventh lower side resin layers 124 to 127 are laminated, the conductive layers 154 to 157 for the electric wire are formed in the fourth through seventh upper side resin layers 114 to 117 respectively, the conductive layers for the pseudo-electric wire are formed in the fourth through seventh lower side resin layers 124 to 127 respectively, and a filling material is filled into the spaces (the common liquid chamber 55, pseudo-spaces 74*a*, 74*b*, individual supply flow passage 72, individual ejection flow passage 73, and so on).

When the filling material is removed from all of the spaces filled with the filling material, the print head 50 shown in FIG. 8 is obtained.

The pseudo-spaces 74*a*, 74*b* are formed to communicate with the outside (atmosphere), and therefore all of the resin in the pseudo-spaces 74*a*, 74*b* is removed.

Figure 15:
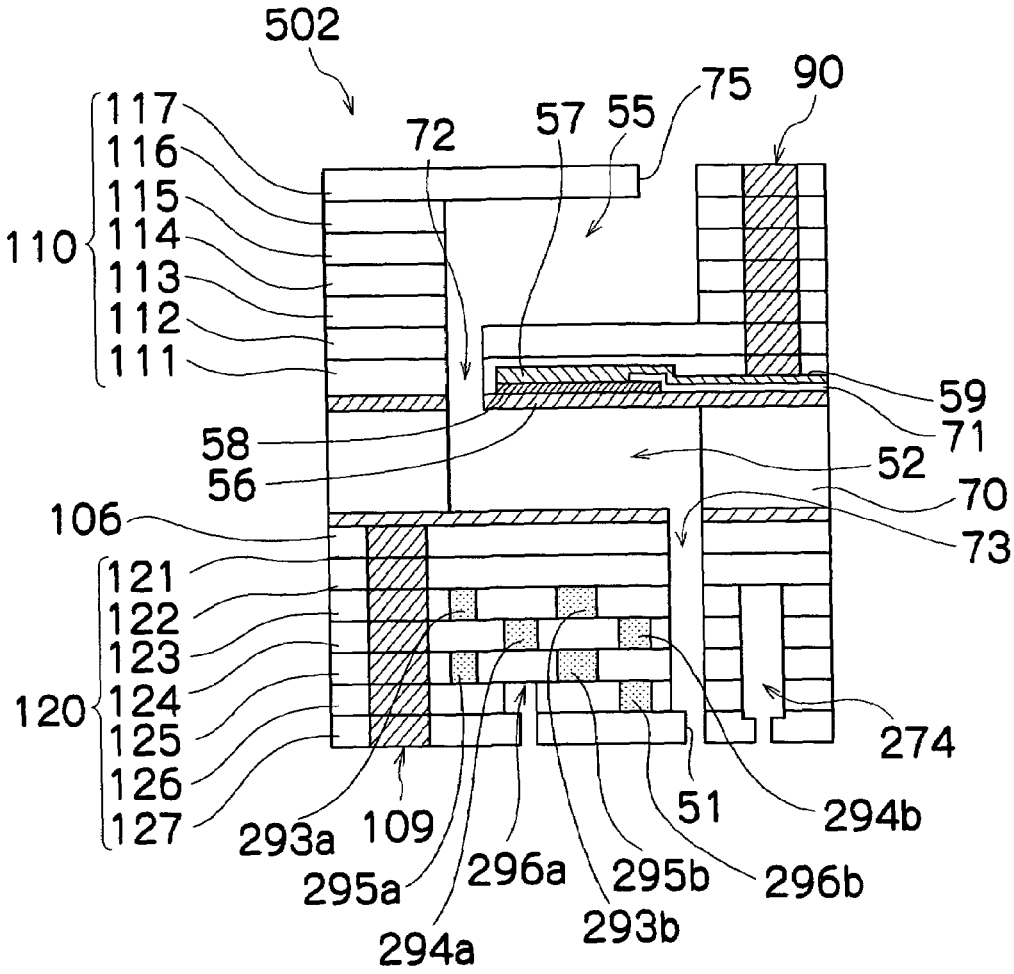
FIG. 15 is a sectional view showing a part of a print head according to a second embodiment.

FIG. 15 is a sectional view showing a print head 502 serving as a liquid ejection head according to a second embodiment of the present invention. In FIG. 15, identical constitutional elements to the constitutional elements of the print head 50 according to the first embodiment, shown in FIG. 8, have been allocated identical reference symbols, and detailed description thereof has been omitted.

The print head 502 of the second embodiment shown in FIG. 15 differs from the print head 50 of the first embodiment shown in FIG. 8 in comprising pseudo-spaces 274, 296*a* which communicate with the outside of the print head 502, and enclosed, isolated pseudo-spaces 293*a*, 293*b*, 294*a*, 294*b*, 295*a*, 295*b*, 296*b* (isolated pseudo-spaces) that do not communicate with the outside of the print head 502. Hence the filling material is removed only from the pseudo-spaces 274, 296*a* which communicate with the outside of the print head 502. The filling material is not removed from the isolated pseudo-spaces 293*a*, 293*b*, 294*a*, 294*b*, 295*a*, 295*b*, 296*b*, and therefore these spaces remain filled.

Further, in the print head 502 of the second embodiment shown in FIG. 15, the pseudo-spaces are more widely dispersed than those of the print head 50 of the first embodiment shown in FIG. 8. More specifically, as shown in FIG. 15, the pseudo-spaces (small pseudo-spaces) 293*a*, 293*b*, 294*a*, 294*b*, 295*a*, 295*b*, 296*a*, 296*b*, each having a substantially square shaped cross-section and a comparatively small sectional area, are disposed differently in the resin layers in the cross-section of the print head 502 and dispersed evenly in both the horizontal and vertical directions.

The manufacturing process for the print head 502 of the second embodiment differs from the second example of the manufacturing process for the print head 50 of the first embodiment (in which manufacturing is performed while filling the spaces with resin), described with reference to FIGS. 12A to 12F, 13A to 13D, and 14A to 14D, in the process for forming the opening portions constituting the pseudo-spaces (FIG. 14B), but is otherwise identical to the second example of the manufacturing process for the print head 50 of the first embodiment.

When forming the opening portions for the pseudo-spaces during the manufacturing process for the print head 502 of the second embodiment, the isolated pseudo-spaces 293*a*, 293*b*, 294*a*, 294*b*, 295*a*, 295*b*, 296*b* which do not communicate with the outside are formed as shown in FIG. 15, and the pseudo-spaces (small pseudo-spaces) 293*a*, 293*b*, 294*a*, 294*b*, 295*a*, 295*b*, 296*a*, 296*b* having a comparatively small sectional area are formed to be evenly dispersed in both the horizontal direction and vertical direction.

During the final process, i.e. removing the resin that fills the spaces (the process described with reference to FIG. 14D in the first embodiment), resin is removed from the spaces which communicate with the outside (the pressure chamber 52, common liquid chamber 55, individual supply flow passage 72, individual ejection flow passage 73, the pseudo-spaces 274, 296*a* which communicate with the outside, the nozzle 51, and so on), but the isolated pseudo-spaces 293*a*, 293*b*, 294*a*, 294*b*, 295*a*, 295*b*, 296*b* that do not communicate with the outside remain filled with resin. As a result, the print head 502 shown in FIG. 15 is obtained.

Figure 16:
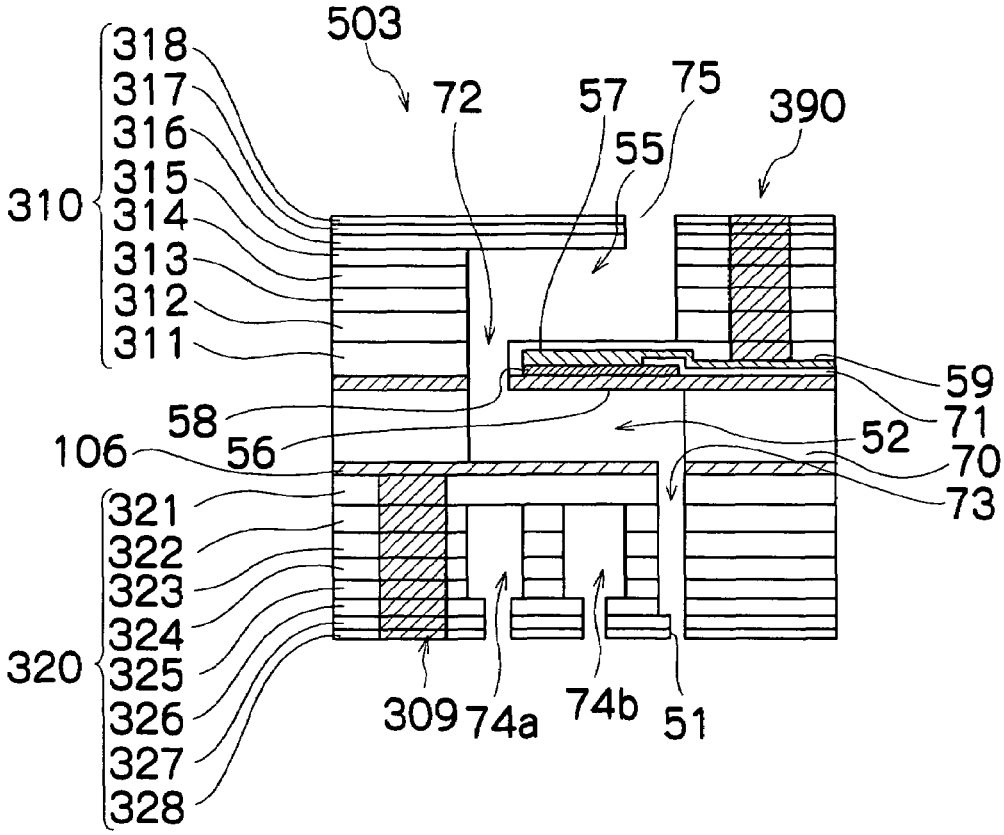
FIG. 16 is a sectional view showing a part of a print head according to a third embodiment.

FIG. 16 is a sectional view showing a print head 503 serving as a liquid ejection head according to a third embodiment of the present invention. In FIG. 16, identical constitutional elements to the constitutional elements of the print head 50 according to the first embodiment, shown in FIG. 8, have been allocated identical reference symbols, and detailed description thereof has been omitted.

The print head 503 of the third embodiment shown in FIG. 16 differs from the print head 50 of the first embodiment shown in FIG. 8 in that the thickness of the laminated layers decreases steadily away from the core substrate 70, and in that a first laminated resin layer portion 310 constituted by eight upper side resin layers 311 through 318, and a second laminated resin layer portion 320 constituted by eight lower side resin layers 321 through 328, are formed. As a result, warping of the structural body formed by laminating together these resin layers can be prevented even further.

The manufacturing process for the print head 503 of the third embodiment differs from the first example of the manufacturing process for the print head 50 of the first embodiment (in which the spaces are filled with resin), described with reference to FIGS. 9A to 9E, 10A to 10D, and 11A to 11D, or the second example of the manufacturing process for the print head 50 of the first embodiment (in which manufacturing is performed while filling the spaces with resin), described with reference to FIGS. 12A to 12F, 13A to 13D, and 14A to 14D, only in that the thickness of the resin layers decreases steadily away from the core substrate 70, and is otherwise similar thereto.

When the resin layers are laminated, the corresponding resin layers on the upper side and lower side of the core substrate 70 are laminated at a substantially identical thickness, similarly to the first embodiment. Also similarly to the first embodiment, when laminating the resin layers, the corresponding resin layers on the upper side and lower side of the core substrate 70 are laminated simultaneously.

Figure 17:
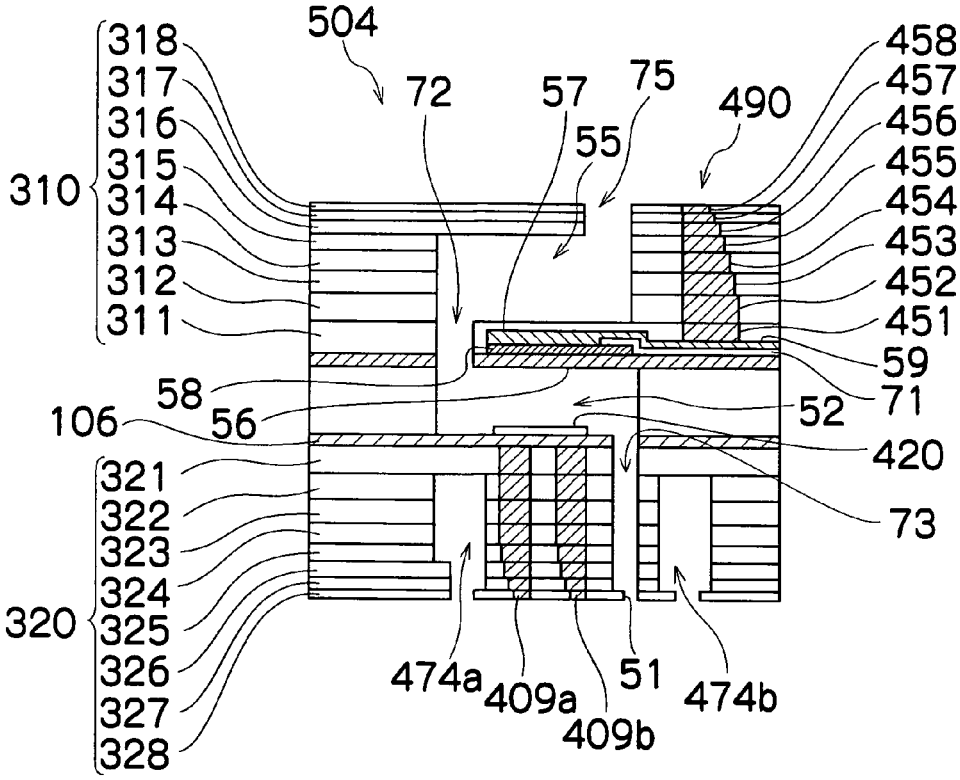
FIG. 17 is a sectional view showing a part of a print head according to a fourth embodiment.

FIG. 17 is a sectional view showing a print head 504 serving as a liquid ejection head according to a fourth embodiment of the present invention. In FIG. 17, identical constitutional elements to the constitutional elements of the print head 503 according to the third embodiment, shown in FIG. 16, have been allocated identical reference symbols, and detailed description thereof has been omitted.

The print head 504 according to the fourth embodiment shown in FIG. 17 differs from the print head 503 of the third embodiment shown in FIG. 16 in that the resin layers 311 through 318 and 321 through 328 are laminated so as to decrease in thickness steadily away from the core substrate 70, and in that conductive layers 451 through 458 are laminated such that a columnar electric wire 490 formed thereby decreases steadily in sectional area as the resin layers become thinner. Conductive layers for forming pseudo-wires 409*a*, 409*b* are laminated similarly to the electric wire 490 such that the pseudo-wires 409*a*, 409*b* decrease steadily in sectional area.

Figure 18:
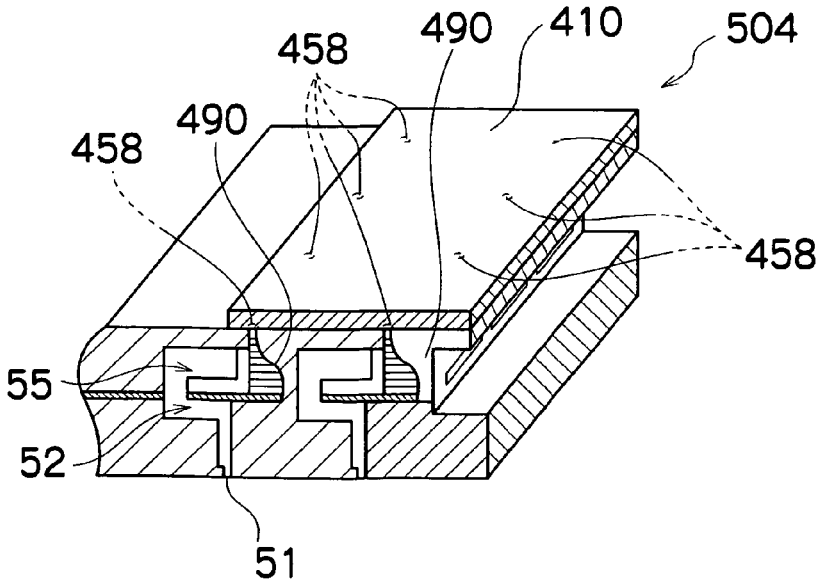
FIG. 18 is a perspective sectional view showing the packaging state of an IC chip for driving the print head of the fourth embodiment.

In the print head 504 of the fourth embodiment, an end portion 458 of the columnar electric wire 490 can be formed with a reduced size. Hence, even when the wires are formed at a high density, a sufficient interval between the end portions 458 of the electric wires 490 can be secured, and therefore a driving IC chip 410 for driving the piezoelectric element 58 can be mounted directly on the print head 504, as shown in FIG. 18. In other words, the driving IC chip 410 can be mounted on the print head 504 by means of high-density packaging such as bump packaging, and as a result, the electric wires 490 can be increased in density on the print head 504 side, enabling an increase in the density of the nozzles 51.

In the description of the first through third embodiments, examples have been cited in which the pseudo-wires 109, 309 on the lower side of the core substrate 70 are not actually used. However, the pseudo-wires 109, 309 may be used as wires (sensor wires) for transmitting input and output signals of various sensors 420, as shown in FIG. 17. The wires used for these sensors are also known as sensor columns.

In the example in FIG. 17, the sensor 420 is disposed on the bottom face of the pressure chamber 52, but may of course be disposed in other positions (in the vicinity of the nozzle 51, for example) depending on the intended use of the sensor. Examples of the intended uses of the sensor include defective ejection determination, temperature measurement, and viscosity measurement.

Further, in the description of the first through fourth embodiments, examples have been cited in which the electric wires 90 (electric columns) are surrounded by the first wiring plates 61 (61*a*, 61*b*, 61*c*, 61*d*) and second wiring plates 62 (62*a*, 62*b*, 62*c*, 62*d*) having a stepped matrix structure (or lattice structure) and constituted by an insulating material, as shown in FIGS. 6 and 7. As a result, the electric wires 90 are insulated and increased in rigidity. However, the present invention is not limited to this constitution, and may be applied to a case in which a vertical electric wire 590 is constituted by a conductive material 5901 on the inside and an insulating material 5902 on the outside, as shown in the sectional view of FIG. 19.

Figure 19:
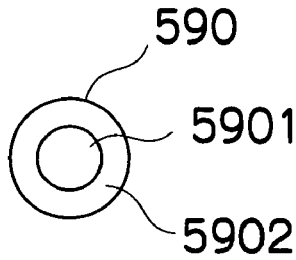
FIG. 19 is a sectional view showing another example of a vertical electric wire.
Figure 20:
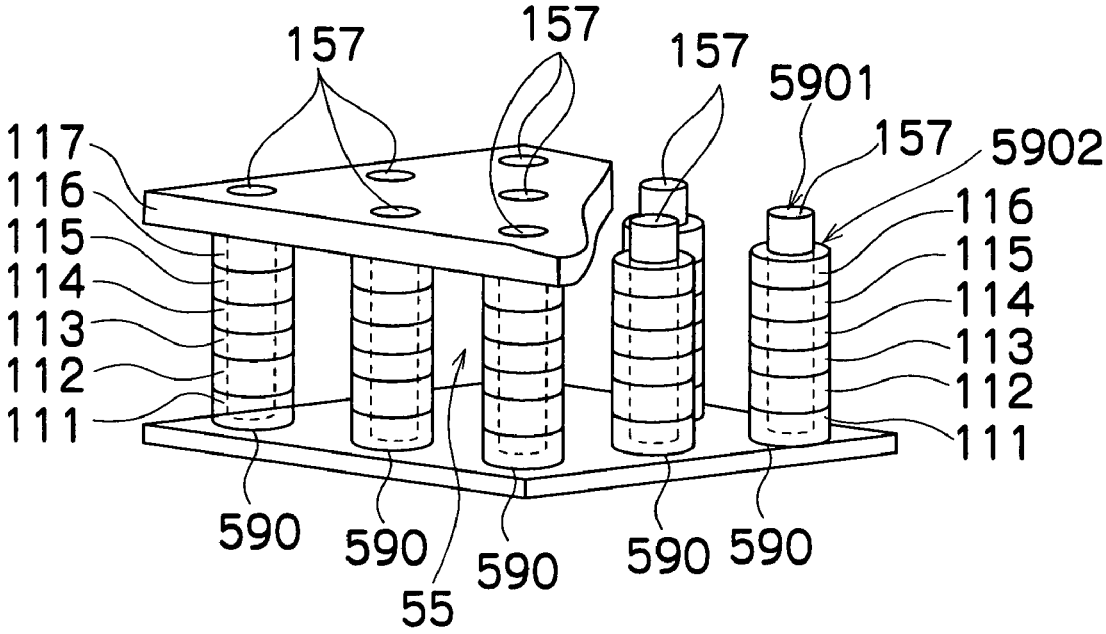
FIG. 20 is a perspective view showing a simplification of a state in which the electric wire of FIG. 19 is disposed in a common liquid chamber.

FIG. 20 is a perspective view showing in simplified form a state in which the electric wire 590 of FIG. 19 is disposed so as to stand vertically upright within the common liquid chamber 55. FIG. 20 is related to the print head 50 of the first embodiment shown in FIG. 8, and therefore the reference numerals 111 through 117 are allocated to the resin layers. Also A part of the uppermost resin layer 117 (the seventh upper side resin layer) has been removed in the drawing. The seventh conductive layer 157 is exposed through the uppermost layer 117 to serve as an end portion electrode of the conductive material 5901 shown in FIG. 19. The first upper side resin layer 111 through seventh upper side resin layer 117 are illustrated as the insulating layer 5902 in FIG. 19.

The manufacturing method for the liquid ejection head is not limited to the examples described above with reference to FIGS. 9A through 14D, and may be subjected to various improvements.

For example, the wall surfaces of the common liquid chamber 55 may be subjected to further processing with the aim of improving the liquid-resistance to ink, preventing surface roughness, and so on.

Furthermore, the glass fiber that is exposed through the wall surface of the pressure chamber 52 provided in the core substrate 70 may be processed, for example.

The liquid ejection head and liquid ejection head manufacturing method of the present invention have been described in detail above, but the present invention is not limited to the above examples, and may of course be subjected to various design modifications and improvements within a scope that does not depart from the spirit of the present invention.

What is claimed is:

1. A liquid ejection head, comprising:

a core substrate of which base material is fiber, the core substrate being provided with a plurality of ejection ports and a plurality of pressure chambers which communicate respectively with the plurality of ejection ports;

a diaphragm which is attached to one surface of the core substrate and has a piezoelectric element disposed thereon;

a first laminated resin layer portion which is formed by laminating resin thin plates onto the surface of the core substrate to which the diaphragm is attached, the first laminated resin layer portion being provided with a common liquid chamber that supplies a liquid to the plurality of pressure chambers;

a second laminated resin layer portion which is formed by laminating resin thin plates onto a surface of the core substrate opposite to the surface to which the diaphragm is attached, the second laminated resin layer portion being provided with a plurality of ejection flow passages that connect the plurality of pressure chambers respectively to the plurality of ejection ports; and a plurality of drive wires which supply a drive signal to the piezoelectric element, at least a part of the plurality of drive wires being formed within the first laminated resin layer portion in a substantially perpendicular direction to the surface on which the piezoelectric element is disposed, thereby standing upright within the common liquid chamber.

2. The liquid ejection head as defined in claim 1, wherein the core substrate is constituted by a glass epoxy resin comprising glass fiber and epoxy resin.

3. The liquid ejection head as defined in claim 1, wherein the second laminated resin layer portion is formed with at least one of a pseudo-space which communicates with outside, and a filled portion constituted by an enclosed space from which a filling material is not removed.

4. The liquid ejection head as defined in claim 1, wherein the second laminated resin layer portion is formed with electric wires parallel to the drive wires.

5. The liquid ejection head as defined in claim 1, wherein a number of the thin plates constituting the first laminated resin layer portion is identical to a number of the thin plates constituting the second laminated resin layer portion.

6. The liquid ejection head as defined in claim 1, wherein the thin plates constituting the first laminated resin layer portion and the second laminated resin layer portion decrease in thickness steadily away from the core substrate.

7. The liquid ejection head as defined in claim 1, wherein a sectional area of each of the drive wires decreases steadily away from the core substrate.

8. An image forming apparatus, comprising the liquid ejection head as defined in claim 1.

* * * * *